US007900489B2

(12) United States Patent
Roth et al.

(10) Patent No.: US 7,900,489 B2
(45) Date of Patent: Mar. 8, 2011

(54) LOCK ASSEMBLY

(75) Inventors: Brian K. Roth, Elbert, CO (US); John B. Harris, Manitou Springs, CO (US); James D. Ohl, Colorado Springs, CO (US); Raymond H. Lammers, Colorado Springs, CO (US); William J. Dickhans, Colorado Springs, CO (US); Shivanand Shivalli, Colorado Springs, CO (US)

(73) Assignee: Schlage Lock Company, Carmel, IN (US)

( * ) Notice: Subject to any disclaimer, the term of this patent is extended or adjusted under 35 U.S.C. 154(b) by 571 days.

(21) Appl. No.: 11/782,606

(22) Filed: Jul. 24, 2007

(65) Prior Publication Data

US 2009/0025436 A1 Jan. 29, 2009

(51) Int. Cl.
*E05B 9/08* (2006.01)

(52) U.S. Cl. ..... 70/134; 70/370; 70/372; 70/381; 70/449; 70/451

(58) Field of Classification Search ..... 70/134, 70/370–374, 381, 447–452, 466
See application file for complete search history.

(56) References Cited

U.S. PATENT DOCUMENTS

| | | | | | |
|---|---|---|---|---|---|
| 2,929,649 | A * | 3/1960 | Coe | 292/169.22 |
| 3,209,569 | A * | 10/1965 | Bryson et al. | 70/440 |
| 3,514,983 | A * | 6/1970 | Krook et al. | 70/370 |
| 3,853,341 | A * | 12/1974 | MacDonald | 292/171 |
| 4,012,929 | A * | 3/1977 | Solovieff | 70/134 |
| 4,202,587 | A * | 5/1980 | Wieland | 312/219 |
| 4,756,638 | A * | 7/1988 | Neyret | 403/261 |
| 5,249,444 | A * | 10/1993 | Dancs | 70/380 |
| 5,722,273 | A * | 3/1998 | Lin et al. | 70/370 |
| 6,161,404 | A * | 12/2000 | Westwinkel | 70/370 |
| 6,230,528 | B1 * | 5/2001 | Don et al. | 70/370 |
| 6,397,647 | B1 * | 6/2002 | Kuo | 70/423 |
| 7,596,975 | B1 * | 10/2009 | Yuan et al. | 70/134 |
| 2006/0179904 | A1 * | 8/2006 | Shen | 70/370 |
| 2007/0180876 | A1 * | 8/2007 | Shen | 70/449 |
| 2008/0190150 | A1 * | 8/2008 | Hoffmann | 70/91 |

OTHER PUBLICATIONS

Locksmith Ledger, The New Medeco Maxum Deadbolt, Jul. 2006, pp. 32-34.

* cited by examiner

*Primary Examiner* — Lloyd A Gall
(74) *Attorney, Agent, or Firm* — Michael Best & Friedrich LLP

(57) ABSTRACT

A lock cylinder for a door including an opening, and operable to interact with a latch bolt assembly. The lock cylinder includes a housing that has a cavity, and a plug assembly that has a casing and a plug housed in the casing and rotatable between a locked position and an unlocked position. The plug is operable to interact with the latch bolt assembly, and the casing is disposed within the cavity. The lock cylinder also includes a spin ring member that at least partially encloses the housing, and an adapter that is configured to be installed in the opening of the door and that includes a spin ring interface engaged with the spin ring member. The adapter further includes a shield portion extendable into the opening of the door, and the spin ring interface and the shield portion are formed as a single piece.

56 Claims, 14 Drawing Sheets

LOCK ASSEMBLY

BACKGROUND

The present invention relates to a lock cylinder. More particularly, the present invention relates to a lock cylinder that is mounted in a door and that includes a housing, a plug, a spin ring, and a cross bore adapter.

Generally, lock cylinders are attached to doors and other structures where security is desired. Most conventional lock cylinders operate or interact with a latch bolt assembly that is positioned in an opening or edge bore of the structure. The lock cylinder is positioned in another opening of the door that is generally perpendicular to and in communication with the edge bore.

Typically, these lock cylinders include a housing and a plug assembly that is rotatable relative to the housing between a locked position and an unlocked position. Existing lock cylinders also include a spin ring that receives the housing, a spin ring cover that attaches to the spin ring, an adapter, and a shield. In these lock cylinders, the adapter generally rests against an end of the spin ring, and is not directly attached to the housing, the spin ring, or the shield. The adapter and the shield are separate pieces, and the shield extends into the door to protect the latch bolt assembly. Generally, the spin ring, the adapter, and the shield are loosely and indirectly held together in the door by a fastener that extends through the latch bolt assembly and that attaches the latch bolt assembly to the housing. The spin ring, the adapter, and the shield are trapped between the housing and the latch bolt assembly. In some lock cylinders, an end piece is positioned on a side of the latch bolt assembly that is opposite the side of the shield and the adapter to hold the lock cylinder together after the lock cylinder is coupled to the door.

SUMMARY

Some existing lock cylinders are susceptible to attack or tampering using a pry bar, a pipe wrench, or other devices. The susceptibility of existing lock cylinders to tampering is enhanced by the indirect connection of the spin ring, the adapter, and the shield in the lock cylinder, which creates joints between these separate pieces.

Typically, lock cylinders are provided to an installer from a manufacturer or distributor as separate pieces that are assembled by the installer. The separate pieces of existing lock cylinders make installation of these lock cylinders in the door difficult and time consuming because each component must be held in place until the fastener is passed through the latch bolt assembly and attached to the housing. In some instances, one or more components may fall out of the opening in the door, which adds to the time necessary for installation time of the lock cylinder. Often, one hand of the installer is used to hold components of the lock cylinder, while the other hand of the installer inserts the fastener through the latch bolt assembly and attaches the latch bolt assembly to the lock cylinder.

In one embodiment, the invention provides a lock cylinder for a door that includes an opening. The lock cylinder is operable to interact with a latch bolt assembly, and includes a housing that has a cavity, and a plug assembly that has a casing and a plug housed in the casing. The plug is rotatable between a locked position and an unlocked position, and is operable to interact with the latch bolt assembly. The casing is disposed within the cavity of the housing. The lock cylinder also includes a spin ring member that at least partially encloses the housing, and an adapter that is configured to be installed in the opening of the door. The adapter includes a spin ring interface that is engaged with the spin ring member, and a shield portion that is extendable into the opening of the door. The spin ring interface and the shield portion are formed as a single piece.

In another embodiment, the invention provides a lock cylinder for a door that includes an opening. The lock cylinder is operable to interact with a latch bolt assembly, and includes a housing that has a cavity, and a plug assembly that has a casing and a plug housed in the casing. The plug is rotatable between a locked position and an unlocked position, and is operable to interact with the latch bolt assembly. The casing is disposed within the cavity of the housing. The lock cylinder also includes a spin ring member that at least partially encloses the housing, and an adapter that is configured to be installed in the opening of the door, and that is directly attached to the housing.

In yet another embodiment, the invention provides a method of assembling a lock cylinder for a door that includes a wall defining an opening. The lock cylinder is operable to interact with a latch bolt assembly. The method includes providing a housing that includes a cavity, providing a rotatable plug assembly that is insertable into the cavity and that is configured to be operably coupled to the latch bolt assembly, providing a spin ring member that includes a hollow portion, and providing an adapter that is configured to be inserted into the opening in the door. The method also includes inserting the plug assembly into the cavity of the housing, inserting the housing into the hollow portion of the spin ring member, engaging the spin ring member with the adapter, and attaching the adapter to the housing prior to attachment of the latch bolt assembly to the housing and to the plug, and prior to insertion of the adapter into the opening in the door.

In yet another embodiment, the invention provides a lock cylinder for a door that includes an opening. The lock cylinder is operable to interact with a latch bolt assembly, and includes a housing that has a cavity, and a plug assembly that has a casing and a plug housed in the casing. The plug is rotatable between a locked position and an unlocked position, and is operable to interact with the latch bolt assembly. The casing is disposed within the cavity of the housing. The lock cylinder also includes a spin ring member that at least partially encloses the housing, and an adapter that is configured to be installed in the opening of the door, and that is directly attached to the spin ring member.

In yet another embodiment, the invention provides a lock cylinder for a door that includes a wall defining an opening. The lock cylinder is operable to interact with a latch bolt assembly, and includes a housing that has a cavity, and a plug assembly that has a casing and a plug housed in the casing. The plug is rotatable between a locked position and an unlocked position, and is operable to interact with the latch bolt assembly. The casing is disposed within the cavity of the housing. The lock cylinder also includes a spin ring member that at least partially encloses the housing, and an adapter that is coupled to the spin ring member and that includes a wall portion. The lock cylinder also includes at least one movable member that extends outward from the wall portion and that is configured to engage the wall of the door to couple the adapter to the door. The movable member is movable inward toward the wall portion against a force that biases the member outward.

In yet another embodiment, the invention provides a method of assembling a lock cylinder for a door that includes a wall defining an opening. The lock cylinder is operable to interact with a latch bolt assembly. The method includes providing a housing that includes a cavity, and that is configured to interact with the latch bolt assembly, providing a rotatable plug assembly that is insertable into the cavity and that is configured to be operably coupled to the latch bolt assembly, providing a spin ring member that includes a hollow portion, and providing an adapter that includes an aperture defining an axis. The adapter is configured to be inserted into the opening in the door. The method also includes inserting the plug assembly into the cavity of the housing, inserting the housing into the hollow portion of the spin ring member, and attaching the adapter to the spin ring member prior to attachment of the latch bolt assembly to the housing and to the plug, and prior to insertion of the adapter into the opening in the door.

In yet another embodiment, the invention provides a method of installing a lock cylinder into a door. The lock cylinder is operable to interact with a latch bolt assembly. The method includes providing a housing including a cavity, providing a rotatable plug assembly that is insertable into the cavity and that is rotatable between a locked position and an unlocked position. The plug is operable to interact with the latch bolt assembly. The method also includes providing a spin ring member that includes a hollow portion, and providing an adapter that is configured to be inserted into the opening in the door. The adapter includes a wall portion and at least one movable member that extends outward from the wall portion. The movable member is movable inward toward the wall portion against a force that biases the movable member outward. The method further includes inserting the plug assembly into the cavity of the housing, inserting the housing into the spin ring member, attaching the adapter to the spin ring member, and inserting the adapter into the opening in the door so that the movable member engages the wall of the door and at least temporarily holds the adapter in the opening of the door.

Other aspects of the invention will become apparent by consideration of the detailed description and accompanying drawings.

BRIEF DESCRIPTION OF THE DRAWINGS

FIG. 17 is another perspective view of the spacer of FIG. 16.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
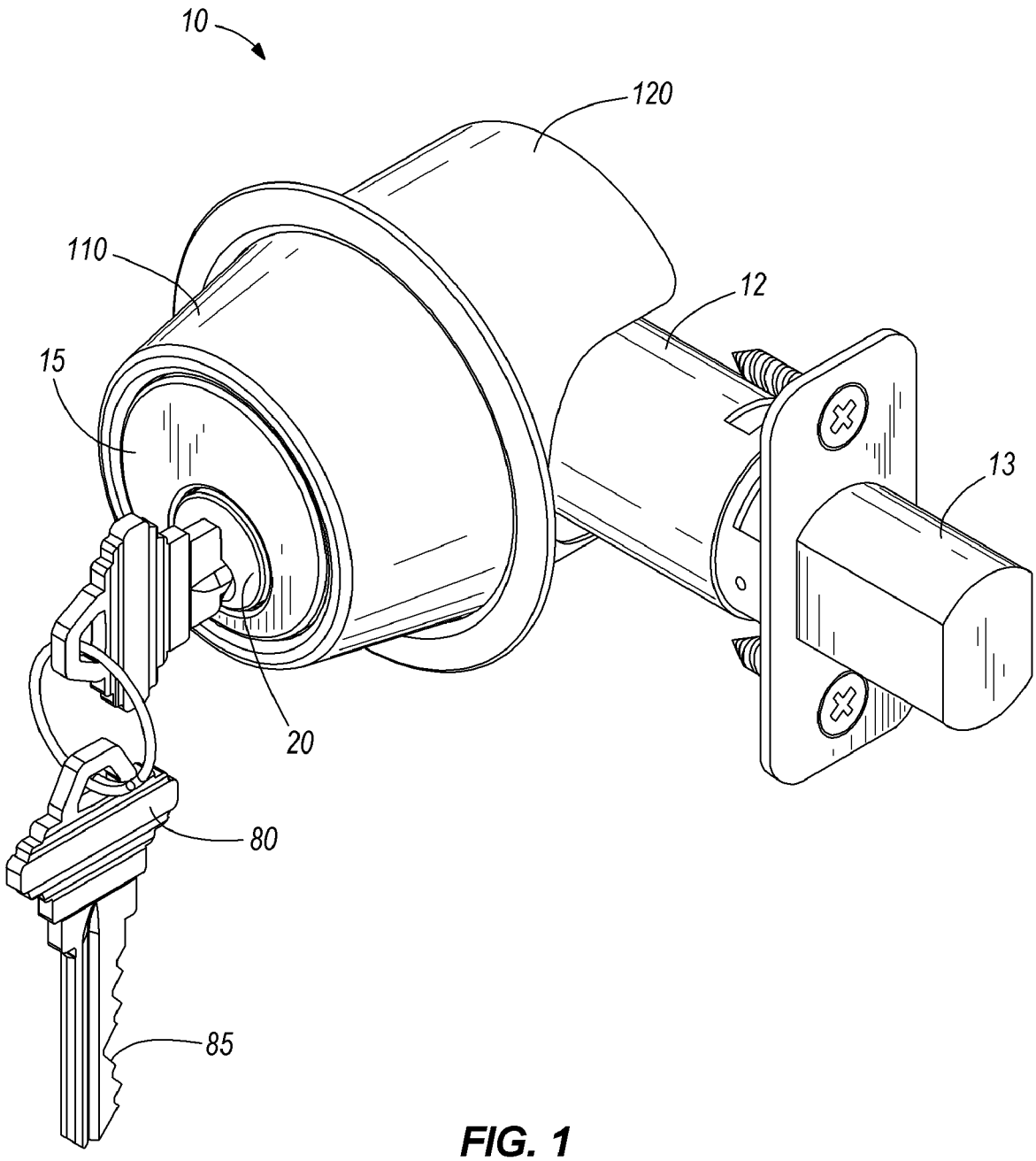
FIG. 1 is a perspective view of a lock cylinder and a latch bolt assembly.
Figure 2:
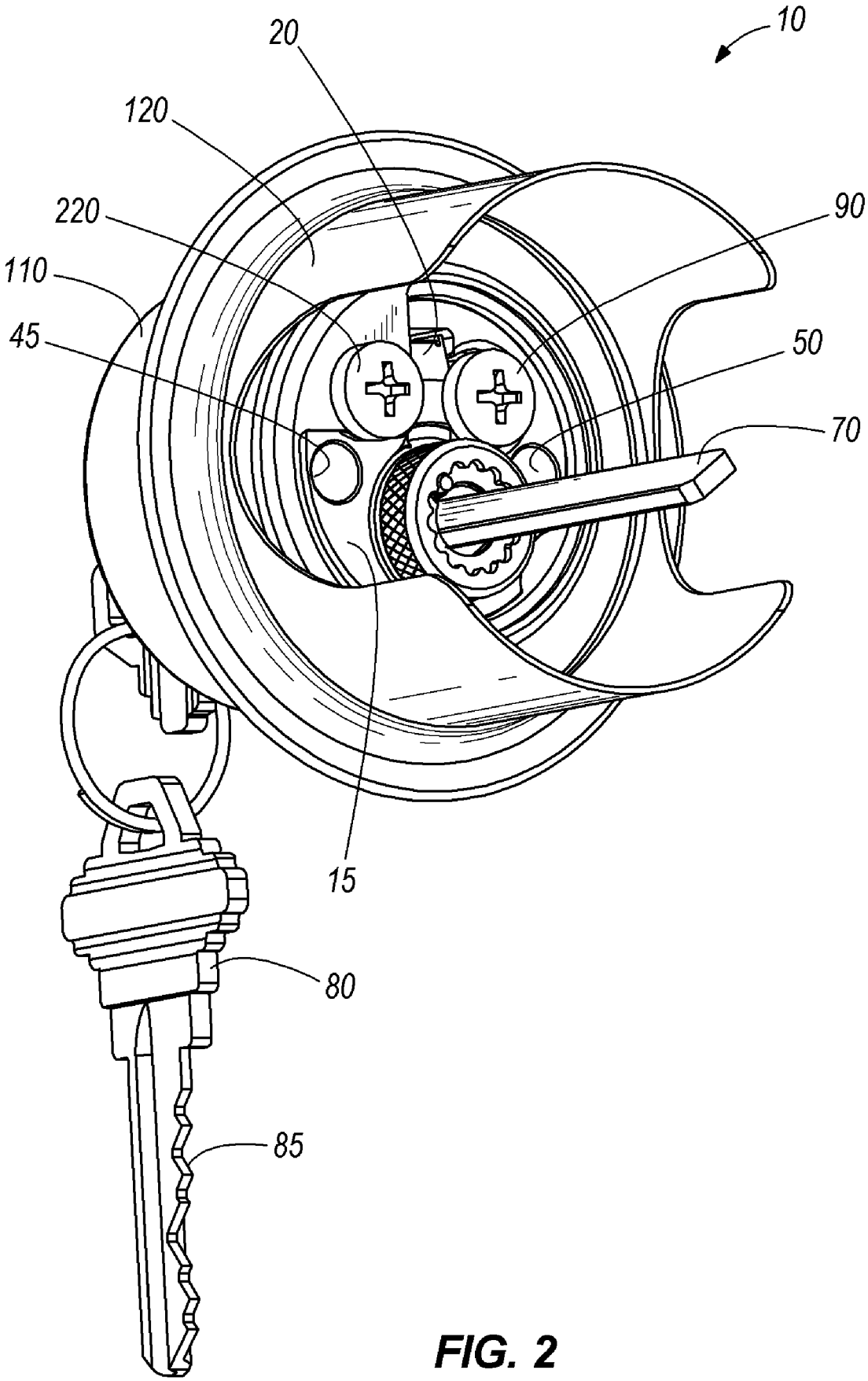
FIG. 2 is another perspective view of the lock cylinder of FIG. 1.

FIGS. 1 and 2 show a lock cylinder 10 for use in commercial or residential applications with structures (e.g., door, access panel, portable locks, etc.) that may be locked and unlocked. Hereinafter, the term "door" shall be used to represent all such lockable structures and shall not be construed to limit the invention's application solely to doors. The lock cylinder 10 is operable to interact with a latch bolt assembly 12 that is disposed in an edge bore (not shown) of the door, and that includes a latch 13 extendable from the latch bolt assembly, and holes 14 disposed through an end of the latch bolt assembly 12 (FIGS. 3 and 4).

Figure 3:
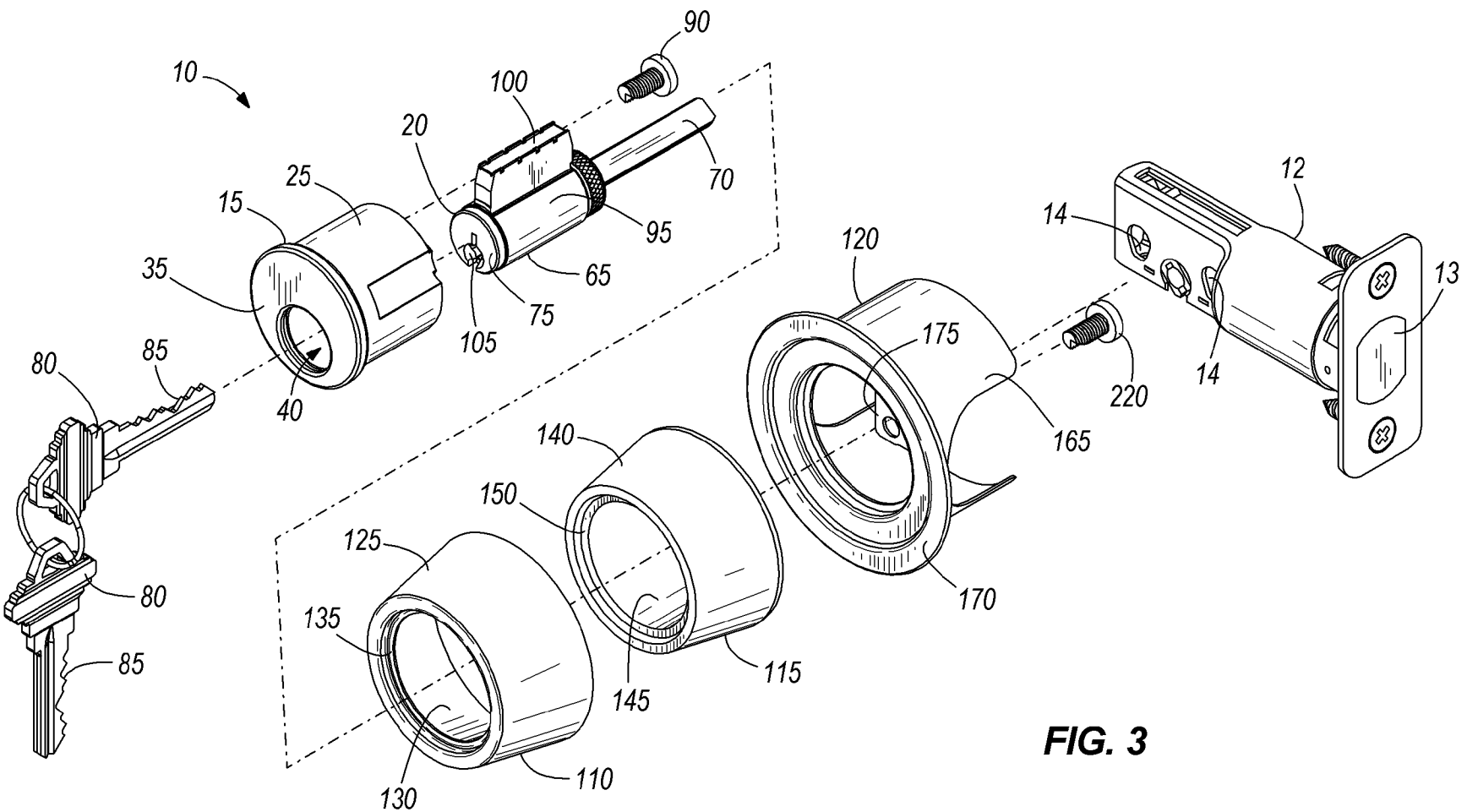
FIG. 3 is an exploded perspective view of the lock cylinder and the latch bolt assembly of FIG. 1.
Figure 4:
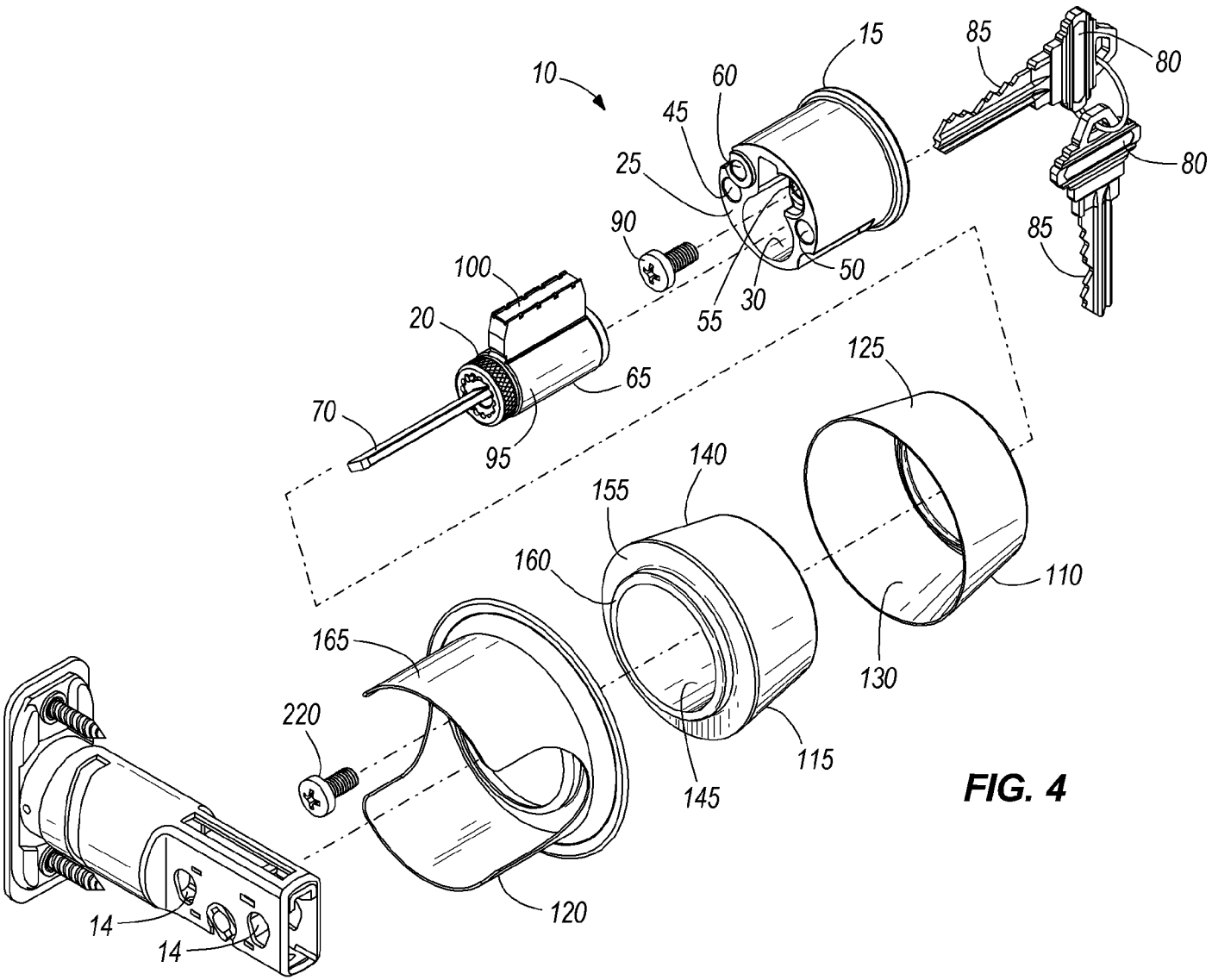
FIG. 4 is another exploded perspective view of the lock cylinder and the latch bolt assembly of FIG. 1.
Figure 5:
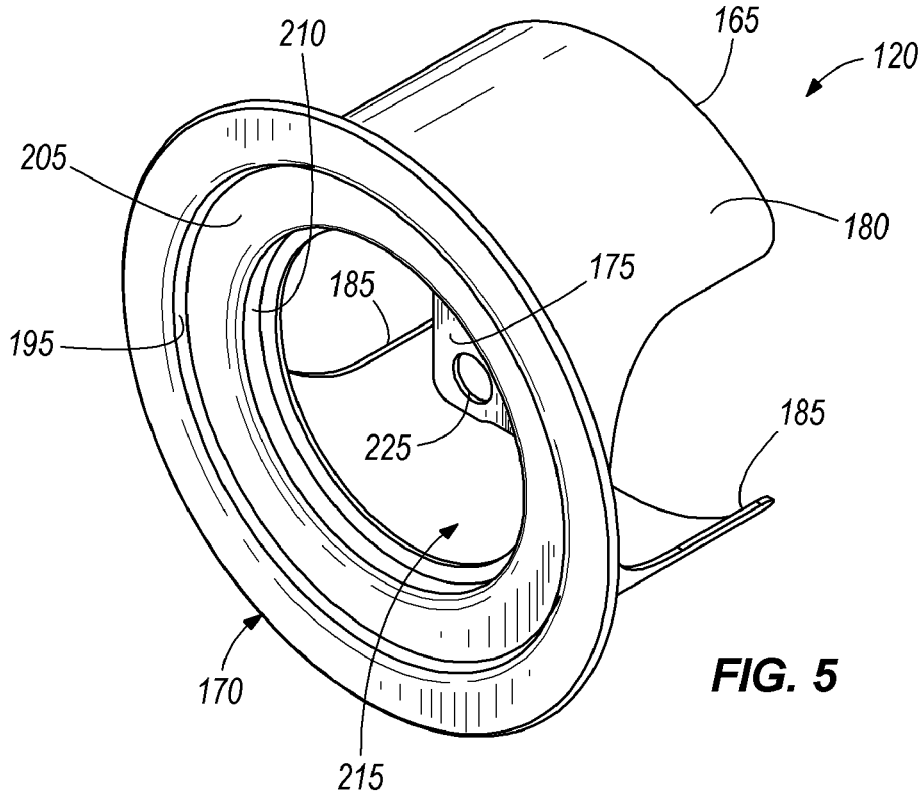
FIG. 5 is a perspective view of an adapter of the lock cylinder of FIG. 1.
Figure 6:
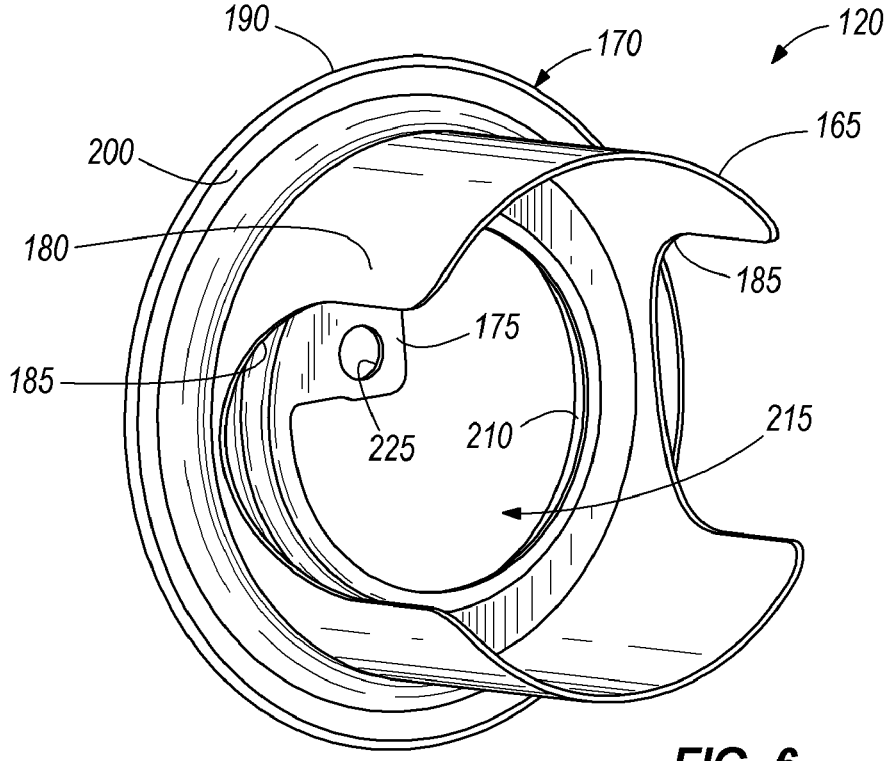
FIG. 6 is another perspective view of the adapter of FIG. 5.
Figure 7:
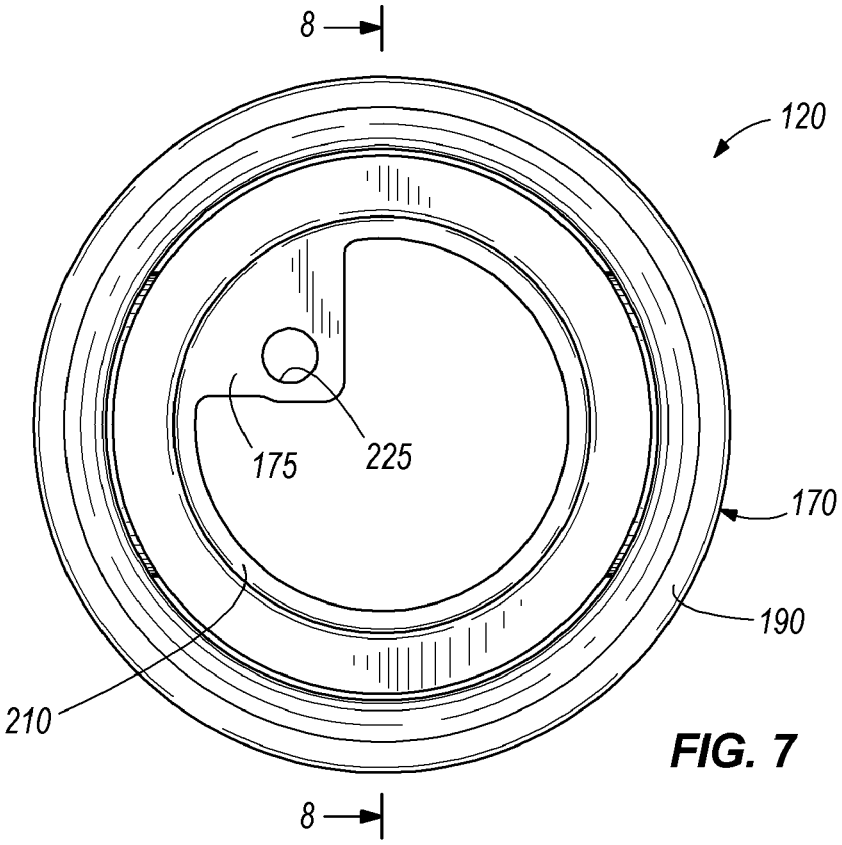
FIG. 7 is a rear view of the adapter of FIG. 5.
Figure 8:
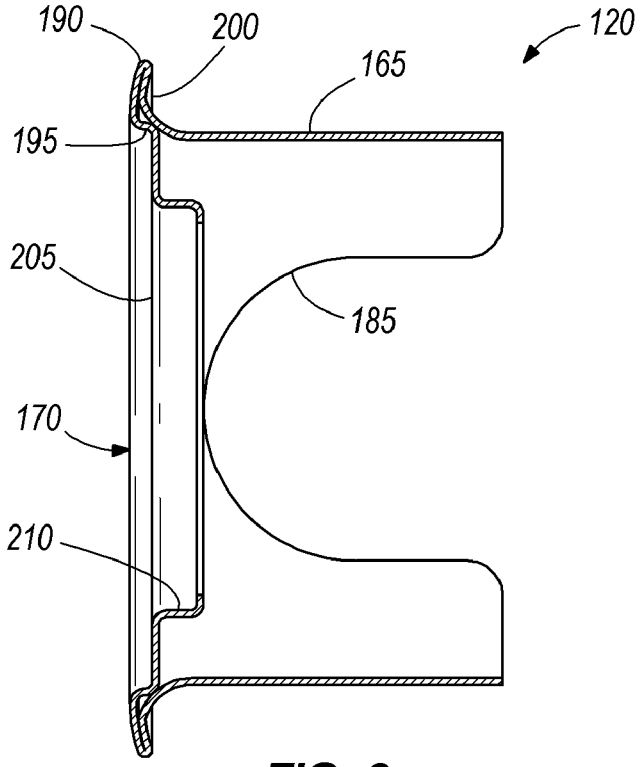
FIG. 8 is a section view of the adapter of FIG. 7 taken along line 8-8.
Figure 9:
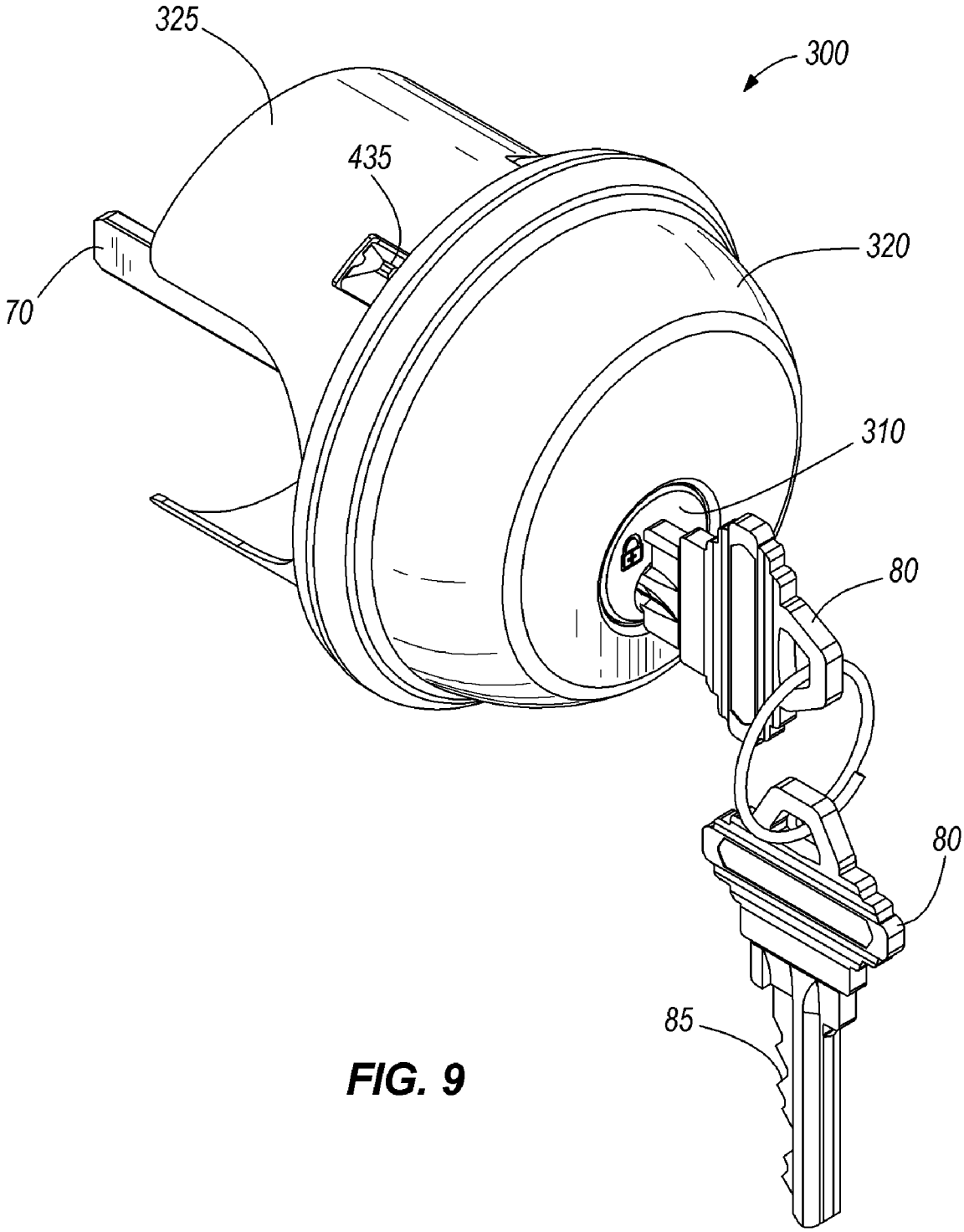
FIG. 9 is a perspective view of another lock cylinder.
Figure 10:
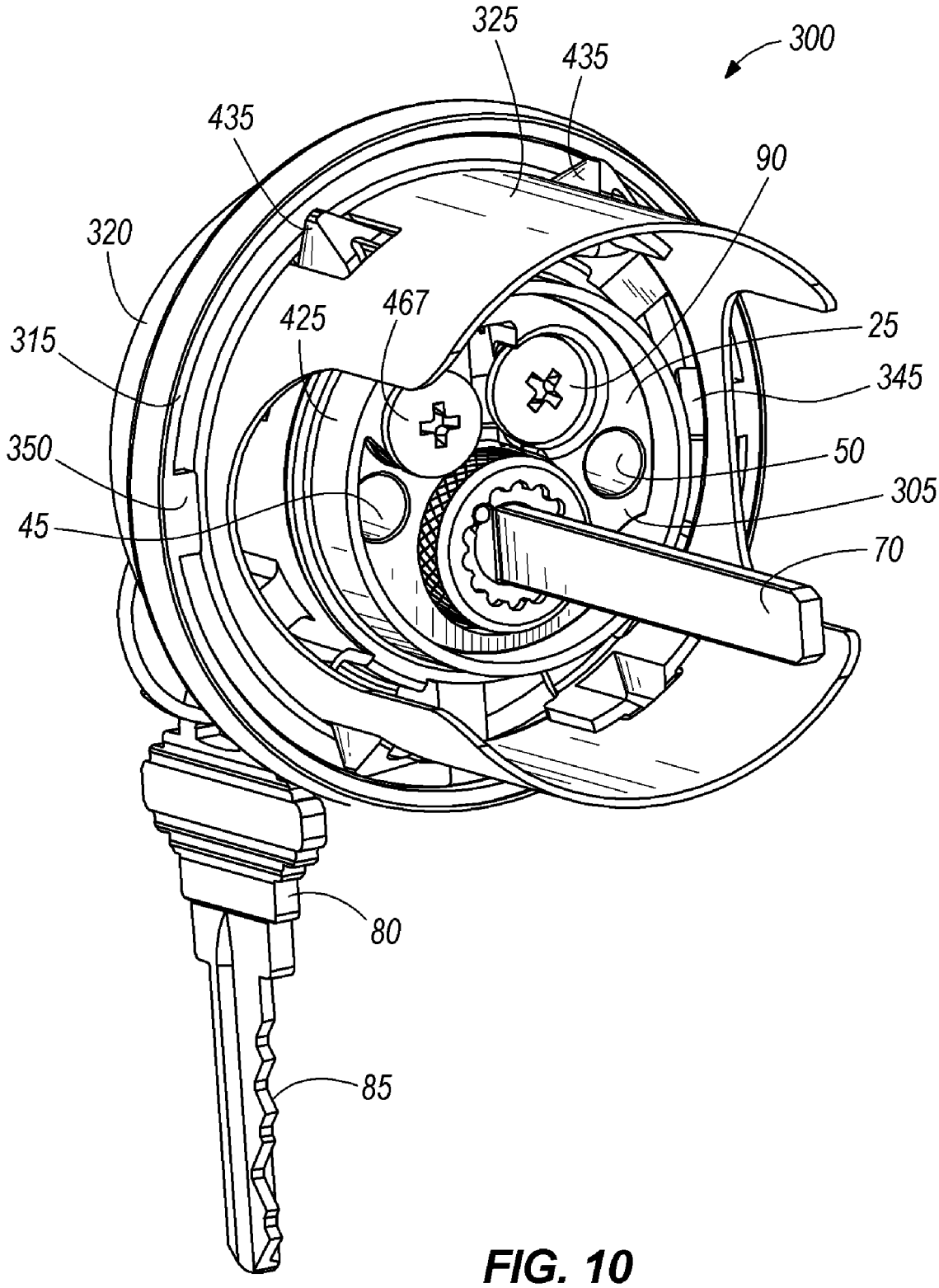
FIG. 10 is another perspective view of the lock cylinder of FIG. 9.

FIGS. 1-4 show that the lock cylinder 10 includes a housing 15 and a plug assembly 20 disposed in the housing 15. FIGS. 3 and 4 show that the housing 15 includes a wall 25 that has a cavity 30, and a face plate 35 that has an aperture 40 in communication with the cavity 30. The housing 15 also includes a first hole 45, a second hole 50, a third hole 55, and a fourth hole 60. In some constructions, the housing 15 may include additional holes.

The plug assembly 20 includes a casing 65, a driver bar 70, and a plug 75 that is configured to be selectively rotatable within the casing 65 using a key 80 that has pin engaging portions 85. The plug assembly 20 is disposed in the cavity 30 of the housing 15, and is attached to the housing 15 using a fastener 90 that is engaged with the third hole 55 of the housing 15, as discussed in detail below. The fastener 90 threadably attaches to the housing 15 within the third hole 55 so that the plug assembly 20 is retained or secured within the cavity 30 by the fastener 90. The illustrated fastener 90 is a bolt or a screw. However, other fasteners may be employed to attach the plug assembly 20 to the housing 15, and should not be limited.

The casing 65 includes a wall 95 and a pin portion 100. The wall 95 is substantially cylindrical and defines a hollow portion that is configured to receive the plug 75. The casing 65 is typically fixed relative to the housing 15 within the cavity 30, and the plug assembly 20 is movable or rotatable relative to the housing 15 between a locked position and an unlocked position. The plug 75 has a key slot 105 that is configured to receive the key 80. The plug 75 is coupled to the driver bar 70 to interact with the latch bolt assembly 12 and to move the latch 13 relative to the door to lock or unlock the door. Such arrangements are well known in the art.

FIGS. 1-4 show that the lock cylinder 10 also includes a spin ring cover 110, a spin ring 115, and an adapter 120. The spin ring cover 110 includes a wall 125 that defines a hollow portion 130 and that includes a first recessed portion 135. The illustrated embodiment shows that the wall 125 includes a substantially frustoconical shape. In some constructions, the wall 125 can be substantially cylindrical. In other constructions, the wall 125 can have other shapes.

The spin ring 115 includes a wall 140 that has a hollow portion 145, and a second recessed portion 150 that is engageable with the first recessed portion 135 of the spin ring cover 110. When the spin ring 115 is disposed in the hollow portion 130 of the spin ring cover 110, an outer surface of the wall 140 of the spin ring 115 is engaged with an inner surface of the wall 125 of the spin ring cover 110. Generally, the shape of the wall 140 substantially corresponds to the shape of the wall 125 of the spin ring cover 110, and the shape of the second recessed portion 150 substantially corresponds to the shape of the first recessed portion 135.

FIG. 4 shows that the spin ring 115 also includes a first annular surface 155 and a protrusion 160. The first annular surface 155 is disposed on an end of the wall 140 that is opposite the second recessed portion 150. In the illustrated embodiment, the first annular surface 155 is substantially planar. In other constructions, the first annular surface 155 may be curved inward or outward from the end of the spin ring 115.

The protrusion 160 extends outward from the first annular surface 155. The illustrated protrusion 160 is defined by an annular ring that extends from the wall 140. In other constructions, the protrusion 160 may have other shapes.

FIGS. 3-8 show the adapter 120 that is coupled to the spin ring 115 and the latch bolt assembly 12, and that is further directly attached to the housing 15. The adapter 120 is configured to be installed in the door, and includes a shield portion 165, an adapter portion or spin ring interface 170, and an attachment member or tab 175. The shield portion 165, the spin ring interface 170, and the attachment member 175 are formed as a single piece from any suitable material (e.g., steel, aluminum, plastic, composite, etc.). In some constructions, the shield portion 165 and the spin ring interface 170 can be formed as a single piece, and the attachment member 175 can be a formed as a separate piece integrated with the shield portion 165 and the spin ring interface 170.

The unitary adapter 120 can be formed using various forming processes. For example, the unitary adapter 120 can be formed by a deep drawing process. In other constructions, the adapter 120 may be formed by using one of many die processes (e.g., transfer die, progressive die, etc.). In still other constructions, the adapter 120 may be formed by other processes (e.g., metal injection molding, machining, die cast, plastic injection molding, rolling, etc.).

FIGS. 1, 5, 6, and 8 show that the shield portion 165 extends from the spin ring interface 170 such that the shield portion 165 is extendable into the opening of the door, and includes a wall portion 180 and a pair of cutouts 185 disposed in the wall portion 180. The cutouts 185 are generally separated from each other by approximately 180 degrees. FIG. 1 shows that the latch bolt assembly 12 extends through the cutouts 185. The illustrated wall portion 180 is substantially cylindrical, although other shapes of the wall portion 180 are possible (e.g., rectangular, etc.).

FIGS. 5-8 show that the spin ring interface 170 includes a door engagement portion 190 and a stepped portion 195 that extends inward from the door engagement portion 190 of the spin ring interface 170. The door engagement portion 190 includes a surface 200 that is engaged with a surface of the door when the adapter 120 is inserted into the door.

The stepped portion 195 includes a second annular surface 205 and a recessed wall 210 that defines an aperture 215. The second annular surface 205 is recessed inward from an end of the spin ring interface 170 that includes the door engagement portion 190, and is engaged with the first annular surface 155 of the spin ring 115 when the spin ring 115 and the adapter 120 are coupled together. The illustrated second annular surface 205 is a substantially planar surface that conforms to the first annular surface 155. In other constructions, the second annular surface 205 may have other surfaces.

The attachment member 175 extends inward from the recessed wall 210 into the aperture 215 to directly attach the adapter 120 to the housing 15 using a fastener 220 that is attached to the housing 15 within the fourth hole 60 (FIGS. 1 and 2). The attachment member 175 is partially disposed in the aperture 215 and includes a hole 225 that receives the fastener 220. The illustrated fastener 220 is a bolt or a screw. However, other fasteners may be employed to directly attach the adapter 120 to the housing 15, and should not be limited. The illustrated attachment member 175 has a substantially triangular profile, although other attachment member profiles are possible and considered herein.

FIGS. 1-4 show the assembly of the lock cylinder 10. The plug assembly 20 is inserted into the housing 15 within the cavity 30, and is retained within the cavity 30 using the fastener 90 that engages an end of the plug assembly 20 and that is threadably attached to the housing 15 within the third hole 55. The fastener 90 traps the pin portion 100 of the plug assembly 20 against the wall 25 of the housing 15.

The spin ring 115 is inserted into the hollow portion 130 of the spin ring cover 110 such that the second recessed portion 150 of the spin ring 115 is engaged with the first recessed portion 135 of the spin ring cover 110. In the illustrated embodiment, the spin ring cover 110 and the spin ring 115 are loosely coupled to each other. In other constructions, the spin ring cover 110 and the spin ring 115 can be securely fastened to each other by crimping the spin ring 115 to the spin ring cover 110, or by other methods (e.g., a fastener that attaches the spin ring 115 to the spin ring cover 110, etc.).

The assembled housing 15 and plug assembly 20 are inserted into the assembled spin ring cover 110 and the spin ring 115, and are at least partially enclosed by the spin ring cover 110 and the spin ring 115 within the hollow portion 145 of the spin ring 115. The face plate 35 is engaged with the first recessed portion 135 so that the end of the housing 15 is substantially co-planar with an end of the spin ring cover 110, and so that the face plate 35 is substantially co-planar with an end of the spin ring cover 110. Engagement of the housing 15 with the first recessed portion 135 substantially centers the housing 15 within the spin ring cover 110. The plug 75 extends through the aperture 40 and is accessible from adjacent the face plate 35.

In some constructions, the lock cylinder 10 may not include the spin ring cover 110. In these constructions, the housing 15 can be directly engaged with the second recessed portion 150 of the spin ring 115 and at least partially enclosed by the wall 140. The spin ring cover 110 and the spin ring 115 support and protect the housing 15 and the plug assembly 20 so that damage to the housing 15 and/or the plug assembly 20 is resisted.

In some constructions, the spin ring 115 can be attached to the spin ring cover 110 after the housing 15 and the plug assembly 20 have been inserted into the spin ring cover 110.

Similarly, in some constructions, the plug assembly 20 can be inserted into the housing 15 after the spin ring 115 is attached to the spin ring cover 110, and prior to engagement of the adapter 120 with the spin ring cover 110 and the spin ring 115.

The spin ring 115 is engaged with the spin ring cover 110 such that a portion of the spin ring cover 110 is recessed within the spin ring interface 170. The spin ring cover 110 and the spin ring 115 are further engaged with the adapter 120 after the housing 15 and the plug assembly 20 have been inserted into cavity of the spin ring cover 110 and the spin ring 115. The first annular surface 155 is engaged with the second annular surface 205 to recess the ends of the spin ring cover 110 and the spin ring 115 within the spin ring interface 170. The protrusion 160 protrudes into the aperture 215 and engages the recessed wall 210 such that the spin ring 115 is substantially centered within the adapter 120. In some constructions, the protrusion 160 may abut the attachment member 175.

The spin ring cover 110 and the spin ring 115 are engaged with the adapter 120 prior to attachment of the adapter 120 to the housing 15, and are retained between the housing 15 and the adapter 120 when the fastener 220 is inserted through the hole 225 in the attachment member 175 and attached to the housing 15. The adapter 120 is directly attached to the housing 15 prior to attachment of the latch bolt assembly 12 to the housing 15 and to the plug assembly 20, and prior to insertion of the adapter 120 into the opening in the door. The fastener is inserted into the hole 225 of the attachment member 175 and is attached to the fourth hole 60. The latch bolt assembly 12 is attached to the housing 15 after the lock cylinder 10 is assembled and attached to the door. Fasteners (not shown) extend through the holes 14 in the latch bolt assembly 12 and are retained in the first and second holes 45, 50 to attach the latch bolt assembly 12 to the housing 15. These fasteners fix the latch bolt assembly 12 relative to the shield portion 165.

The adapter 120 also supports the housing 15, the plug assembly 20, the spin ring cover 110, and the spin ring 115, and shields the latch bolt assembly 12 from tampering. The adapter 120 is rigidly attached to the housing 15 using the fastener 220, which resists one or more of the components of the lock cylinder 10 from separating from the remaining components prior to insertion of the lock cylinder 10 into the door and prior to engagement of the lock cylinder 10 with the latch bolt assembly 12. When the lock cylinder 10 is assembled and attached to the door, the unitary adapter 120 extends to the opening of the door and resists access to the latch bolt assembly 12.

The assembled lock cylinder 10 including the housing 15, the plug assembly 20, the spin ring cover 110, the spin ring 115, and the adapter 120 define a modular assembly that provides easier installation of the lock cylinder 10 into the opening of the door, and that provides a relatively strong lock cylinder 10 that is resistant to tampering, including direct vertical blows to the spin ring cover 110 and/or the adapter 120. In addition, the modular assembly has a relatively low cost due in part to the unitary adapter 120. An installer or user can insert the modular assembly into the opening of the door, and then attach the latch bolt assembly 12 to the housing 15 by inserting the fasteners through the latch bolt assembly 12 without concern for separation of the components of the modular assembly during installation. After the latch bolt assembly 12 is attached to the housing 15, the key 80 can be used to rotate the plug 75 to lock and unlock the door.

FIGS. 9-20 show another embodiment of the invention that includes a lock cylinder 300 for use with the door in commercial or residential applications. The lock cylinder 300 is operable to interact with the latch bolt assembly 12 (FIGS. 1, 3 and 4). The lock cylinder 300 includes a housing 305 and a plug assembly 310. Except as described below, the housing 305 and the plug assembly 310 are similar to the housing 15 and the plug assembly 20 described above with regard to FIGS. 1-8, and common elements are given the same reference numerals.

FIGS. 9-12 show that the lock cylinder 300 also includes a spin ring 315, a spin ring cover 320, and an adapter 325. The spin ring 315 is attached to the spin ring cover 320, and includes a wall 330 that defines a hollow portion 335 and that includes a recessed portion 340. The housing 305 is disposed in the hollow portion 335 such that the housing 305 is at least partially enclosed by the spin ring 315. The face plate 35 engages the recessed portion 340 so that the housing 305 is substantially centered within the spin ring 315. The illustrated construction shows that the spin ring 315 includes a cup or bowl-like shape. In other constructions, the wall 330 can be substantially cylindrical. In still other constructions, the wall 330 can have other shapes.

Figure 12:
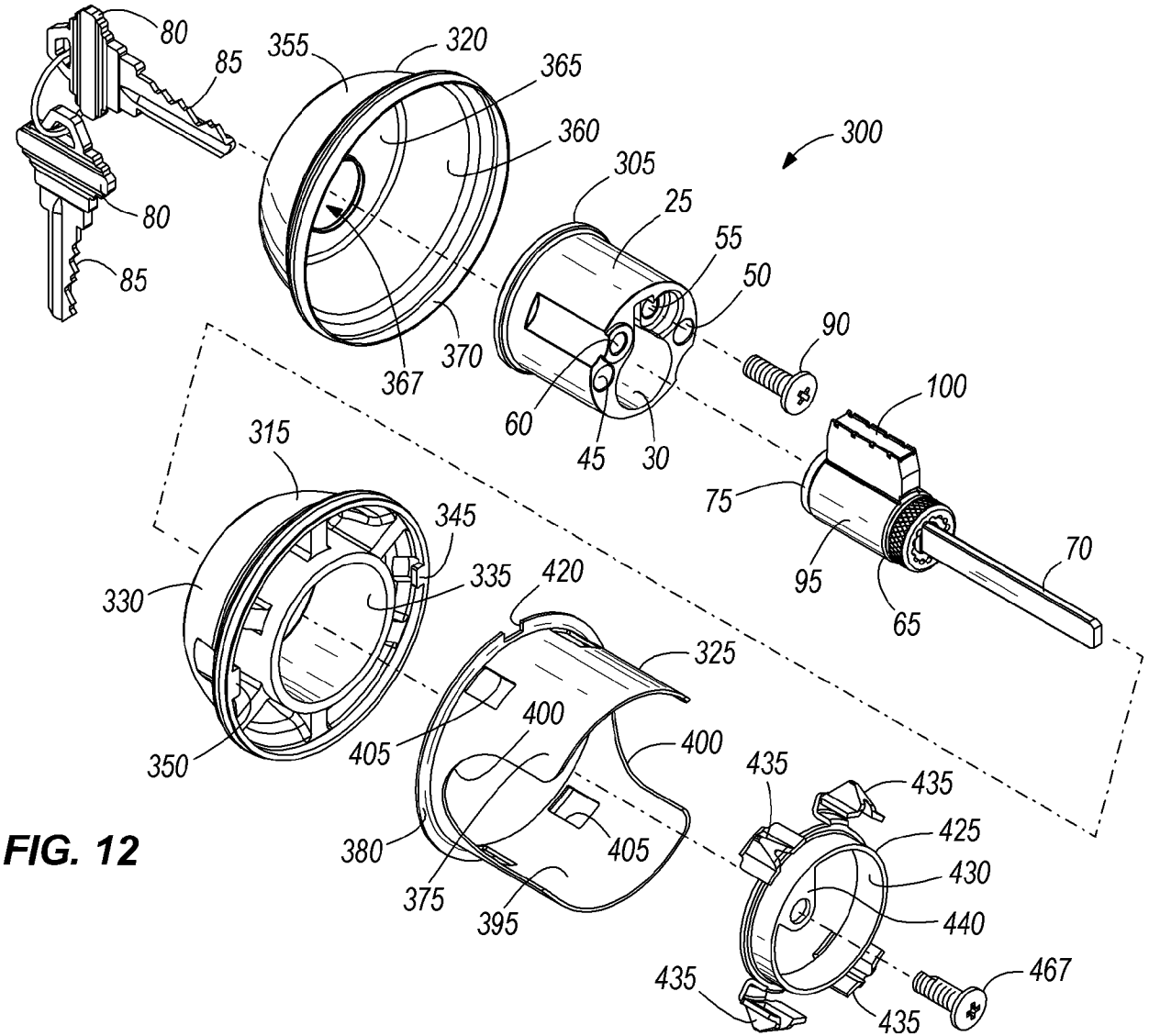
FIG. 12 is another exploded perspective view of the lock cylinder of FIG. 9.

As illustrated in FIG. 12, the spin ring 315 also includes a first tab 345 and a second tab 350 disposed along an inner portion of the wall 330 adjacent an end of the spin ring 315 that is opposite the recessed portion 340. The first and second tabs 345, 350 further extend inward from the wall 330. In some constructions, the second tab 350 can be larger than the first tab 345. In other constructions, the size of the second tab 350 can be substantially equal to the size of the first tab 345. In still other constructions, the second tab 350 can be smaller than the first tab 345. The first and second tabs 345, 350 are substantially rectangular, although other-shaped tabs may also be used. While the illustrated spin ring 315 includes first and second tabs 345, 350, fewer or more than two tabs are considered.

Figure 11:
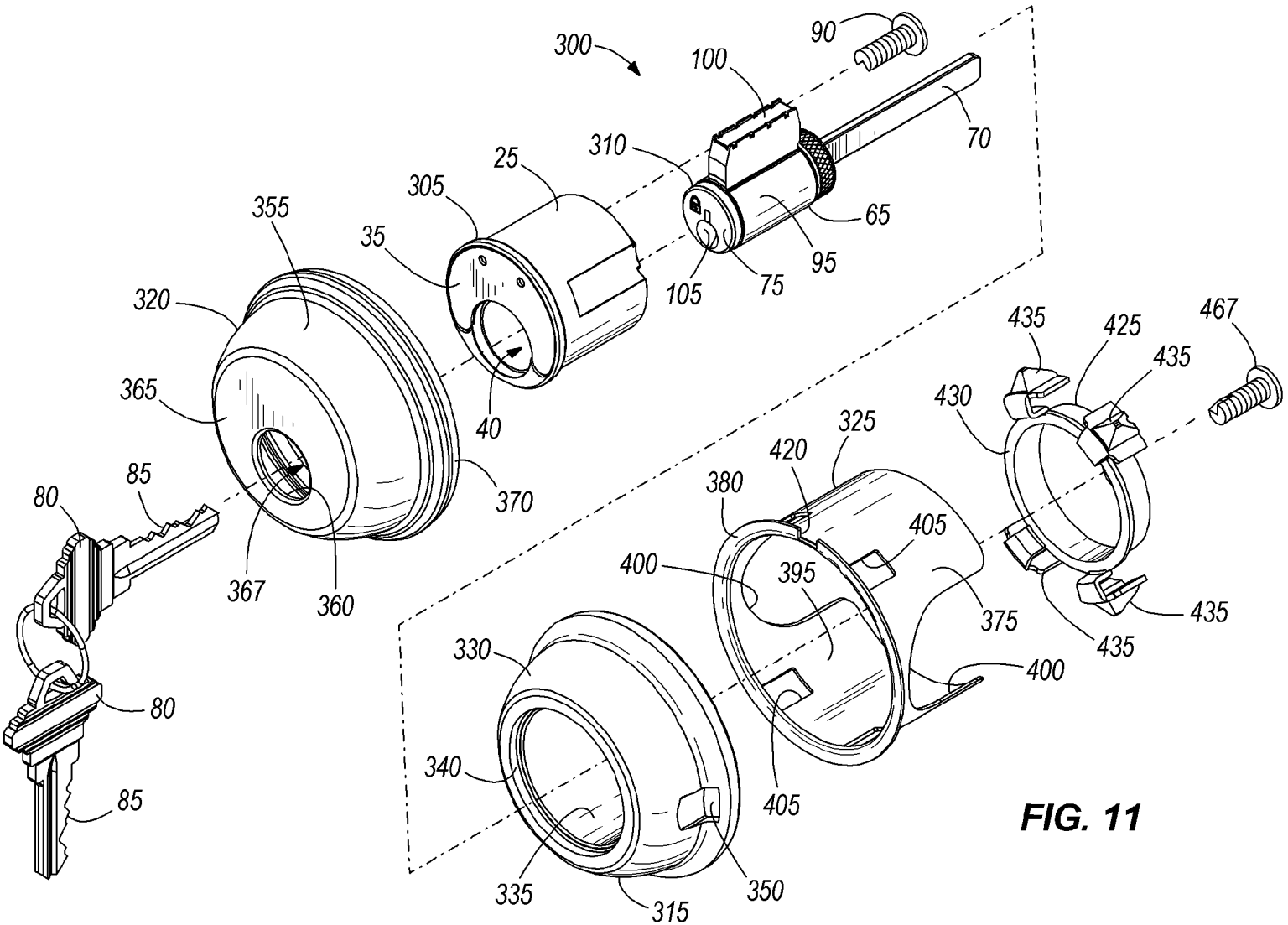
FIG. 11 is an exploded perspective view of the lock cylinder of FIG. 9.

With continued reference to FIGS. 11 and 12, the first and second tabs 345, 350 are separated from each other along the inner portion of the wall 330 by about 180 degrees. In other constructions, the first and second tabs 345, 350 can be separated by less than 180 degrees. In the illustrated construction, the first tab 345 and the second tab 350 are formed using a die tool that extends through the wall 330. However, other manufacturing processes for forming the first and second tabs 345, 350 are considered, and should not be limited to a tool and die process.

The spin ring cover 320 includes a wall 355 that has a hollow portion 360, and a front wall 365 that has therein an aperture 367 in communication with the hollow portion 360. The spin ring 315 is disposed in the hollow portion 360 of the spin ring cover 320 such that an outer surface of the wall 355 of the spin ring 315 is substantially engaged with an inner surface of the wall 355 of the spin ring cover 320. Generally, the shape of the wall 355 of the spin ring cover 320 substantially corresponds to the shape of the wall 330 of the spin ring 315. The face plate 35 is engaged with an inner surface of the front wall 365 when the housing 305 and the spin ring 315 are attached to the spin ring cover 320.

The spin ring cover 320 also includes a crimp portion 370 that is disposed adjacent an end of the wall 355, and that is configured to be crimped around an end of the spin ring 315 to hold the spin ring 315 partially recessed within the hollow portion 360 of the spin ring cover 320. The spin ring 315 may also be coupled to the spin ring cover 320 using other attachment methods.

FIGS. 11-15 show the adapter 325 that is directly attached to the spin ring 315, and further directly attached to the housing 305. The adapter 325 is configured to be installed in the door, and includes a shield portion or adapter wall 375 and an annular flange 380. The illustrated adapter wall 375 is substantially cylindrical, and defines a first axis 385 that extends longitudinally through the adapter 325. The adapter 325 also includes a second axis 390 that is substantially perpendicular to the first axis 385.

The adapter wall 375 and the annular flange 380 are formed as a single piece from any suitable material (e.g., steel, aluminum, plastic, composite, etc.) using one of many manufacturing processes (e.g., deep drawing, transfer die, progressive die, metal injection molding, machining, die cast, plastic injection molding, rolling, etc.).

The adapter wall 375 is extendable into the opening of the door, and defines a hollow portion 395, and a pair of cutouts 400 disposed through the adapter wall 375 and in communication with the hollow portion 395. The cutouts 400 are generally separated from each other by approximately 180 degrees, and are adapted to receive the latch bolt assembly 12. The illustrated adapter wall 375 is substantially cylindrical. However, the adapter wall 375 may include other shapes (e.g., substantially rectangular, etc.).

The adapter wall 375 also includes four openings 405 spaced apart from each other along a circumference of the adapter wall 375 and disposed through the adapter wall 375 adjacent the annular flange 380. In the illustrated construction, the openings 405 are substantially rectangular. Other shapes of the openings 405 are also possible. Generally, the openings 405 are located on the adapter wall 375 between the cutouts 400. In the construction illustrated in FIGS. 13 and 14, two of the openings 405 are located in the adapter wall 375 on an upper side of the adapter 325, and two of the openings 405 are located in the adapter wall 375 on a lower side of the adapter 325. The two openings 405 that are located on the upper side of the adapter 325 are angularly spaced apart by an angle 407. Similarly, the two openings 405 that are located on the lower side of the adapter 325 are angularly spaced apart by the angle 407. In the illustrated construction, the angle 407 is about sixty degrees. In other constructions, the openings 405 may be equally spaced about the adapter wall 375. In still other constructions, the openings 405 may be spaced along the circumference of the adapter wall 375 at any angular distance. While four openings 405 are shown in the illustrated embodiment, the adapter wall 375 may include fewer or more than four openings 405.

Figure 14:
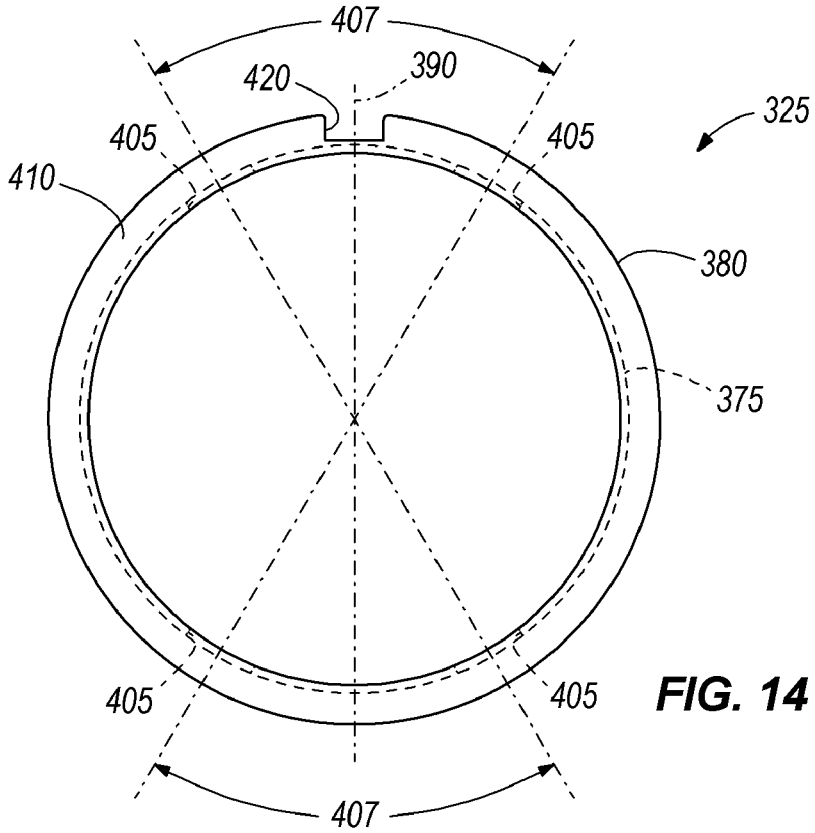
FIG. 14 is a front view of the adapter of FIG. 13.
Figure 15:
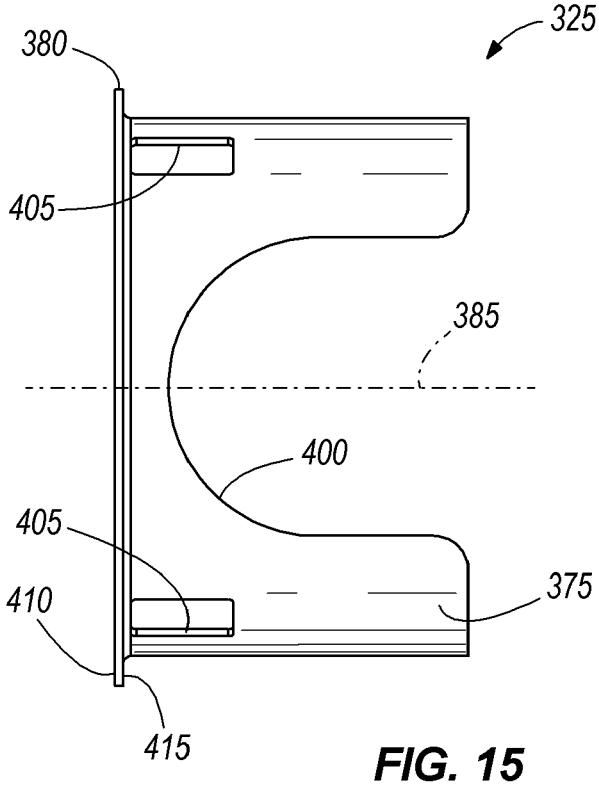
FIG. 15 is a side view of the adapter of FIG. 13.

The annular flange 380 is disposed about a circumference of the adapter wall 375 adjacent an end of the adapter 325. In some constructions, the annular flange 380 is disposed about a portion of the circumference of the adapter wall 375. The annular flange 380 substantially corresponds to a circumference of the inner portion of the wall 330 of the spin ring 315 to provide a relatively tight attachment of the adapter 325 to the spin ring 315. As shown in FIG. 15, the annular flange 380 includes a first surface 410 adjacent the end of the adapter 325 and substantially parallel to the second axis 390, and a second surface 415 that is opposite the first surface 410. As shown in FIG. 14, the second axis 390 is substantially vertical. However, the second axis 390 may be disposed at any angle that is perpendicular to the first axis 385 and that is parallel to the first surface 410. The orientation of the second axis 390 depends in part on the orientation of the first and second tabs 345, 350.

Figure 13:
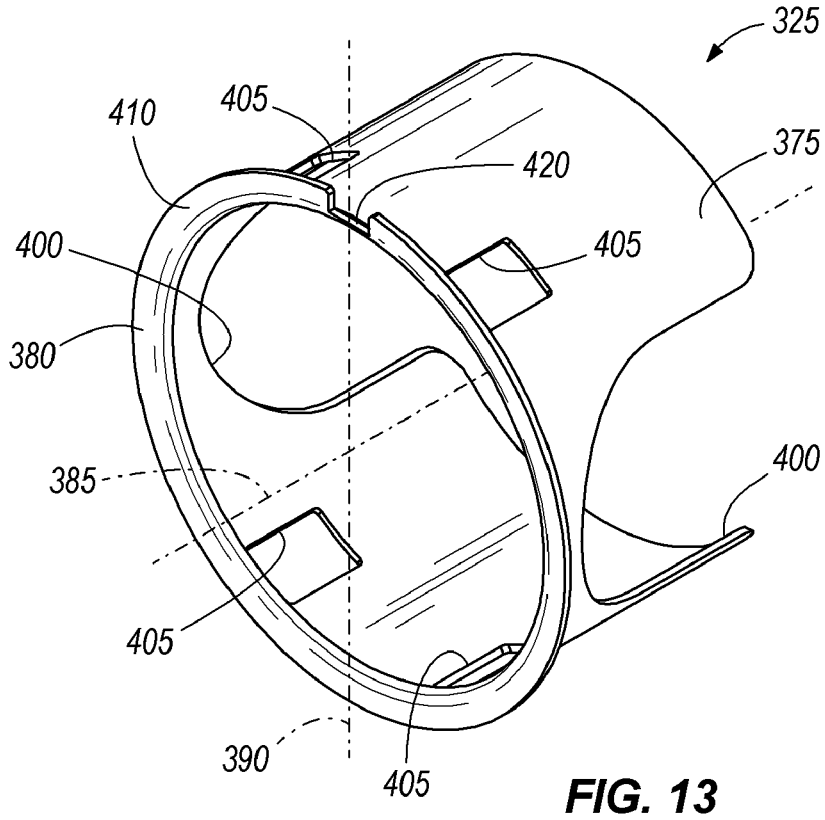
FIG. 13 is a perspective view of an adapter of the lock cylinder of FIG. 9.

FIGS. 13 and 14 show that the annular flange 380 also includes a recess or notch 420 that extends through the annular flange 380. The notch 420 is sized to receive at least one of the first and second tabs 345, 350 to attach the adapter 325 to the spin ring 315. In some constructions, the annular flange 380 may include more than one notch 420.

In some constructions, the annular flange 380 may include the first and second tabs 345, 350. In these constructions, the spin ring 315 includes the notch 420. In other constructions, the annular flange 380 may include one of the first and second tabs 345, 350, and the spin ring 315 may include the other of the first and second tabs 345, 350. In these constructions, a notch 420 can be located in one or both of the spin ring 315 and the annular flange 380. Similarly, in constructions that attach the adapter 325 directly to the spin ring cover 320, the spin ring cover 320 can include the first and second tabs 345, 350, the notch 420, or any other suitable combination.

FIGS. 11 and 12 show that the lock cylinder 300 also includes a spacer 425 that is coupled to the adapter 325, and that is directly attached to the housing 305. As shown in FIGS. 16-20, the spacer 425 includes a hollow body 430, four movable members 435 that extend radially outward from the body 430, and an attachment member 440. The illustrated body 430 is substantially cylindrical, but can have other shapes (e.g., rectangular, triangular, etc.). The body 430 can be formed as a single piece or multiple pieces from any suitable material, including metal, plastic, composites, and the like, using one of many manufacturing processes (e.g., deep drawing, transfer die, progressive die, metal injection molding, machining, die cast, plastic injection molding, rolling, etc.).

The movable members 435 are disposed about the body 430 and are engageable with the adapter 325 within the openings 405, as explained in detail below. In the illustrated construction, the movable members 435 and the body 430 are formed as a single piece. Two movable members 435 disposed on one side of the spacer 425 are angularly spaced from each other on the circumference of the body 430 at an angle 437. Similarly, the remaining two movable members 435 disposed on the other side of the spacer 425 are angularly spaced from each other on the circumference of the body 430 at the angle 437. In the illustrated construction, the angle 407 is about 60 degrees, and the angular spacing between the pairs of movable members is about 120 degrees. In other constructions, the movable members 435 can be angularly spaced about the circumference of the spacer 425 at any angle. The angle 437 and the angle 407 are dependent on each other so that the movable members 435 substantially align with the openings 405. Generally, the quantity of movable members 435 is equal to the quantity of openings 405.

Each of the movable members 435 includes a resilient element 445 and a protrusion 450 that extends from the resilient element 445. The resilient element 445 is formed from a flexible or spring-type material. Generally, the resilient elements 445 are flexible or adjustable to allow inward movement of the protrusions 450 against a spring force defined by the resilient element 445 that biases each of the movable members 435 outward. The resilient elements 445 can be formed from any suitable material that has spring-like or extension-compression properties, such as plastic, metal, composites and the like. The material used for the resilient elements 445 can be the same as or different from the material used to form the body 430. In some constructions, the resilient elements 445 may include springs or other flexible components.

Figure 16:
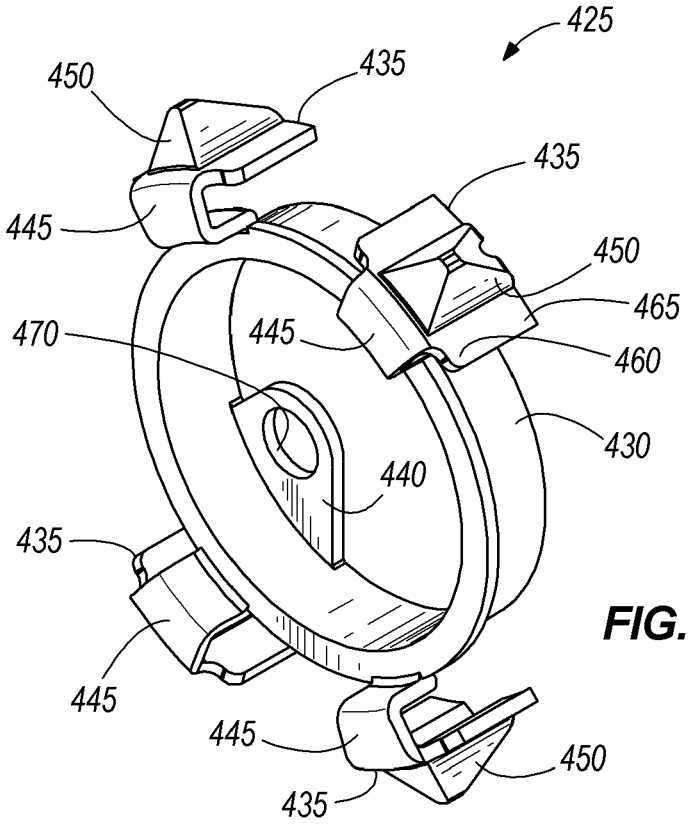
FIG. 16 is a perspective view of a spacer of the lock cylinder of FIG. 9.
Figure 18:
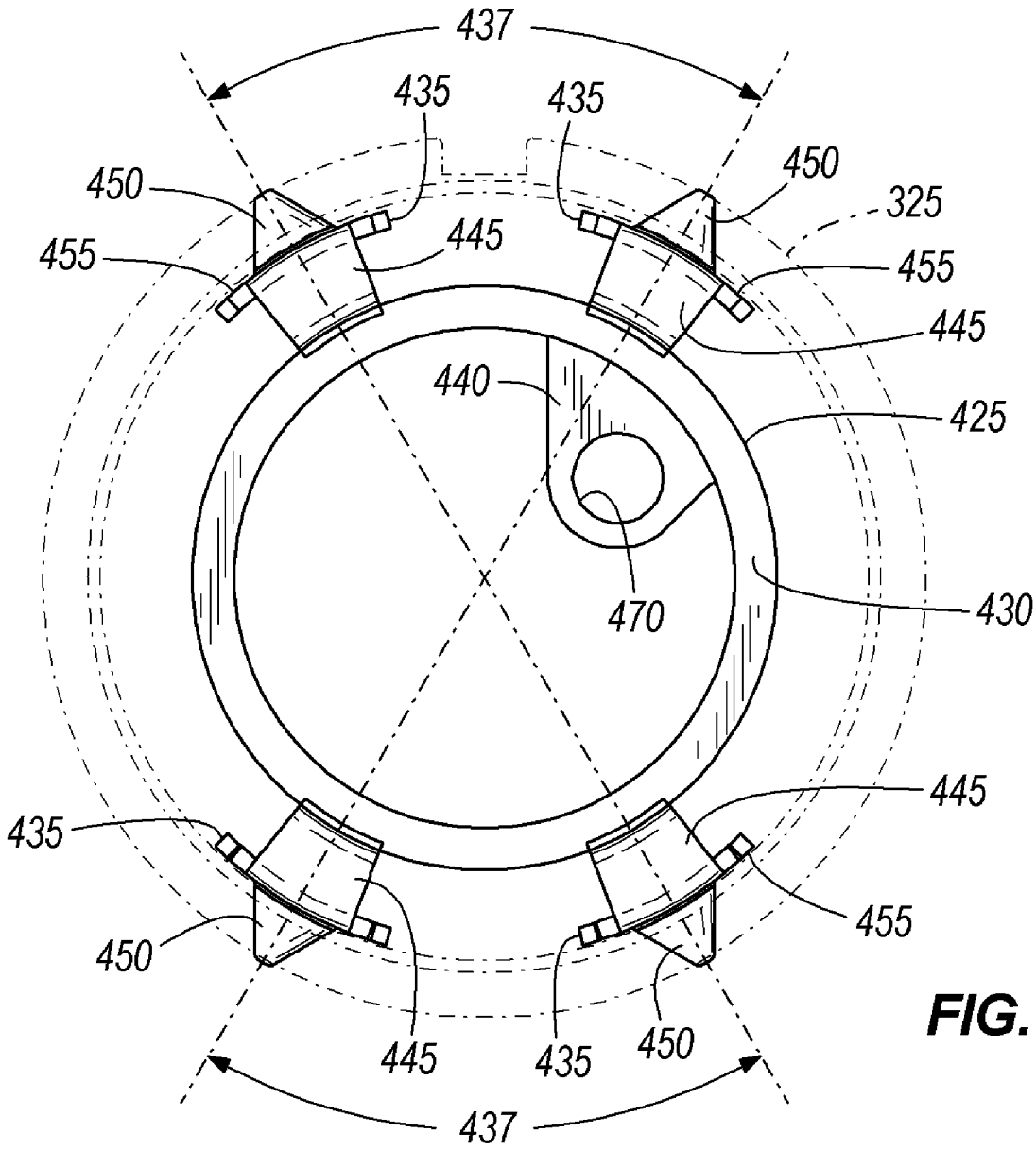
FIG. 18 is a front view of the spacer of FIG. 16.
Figure 19:
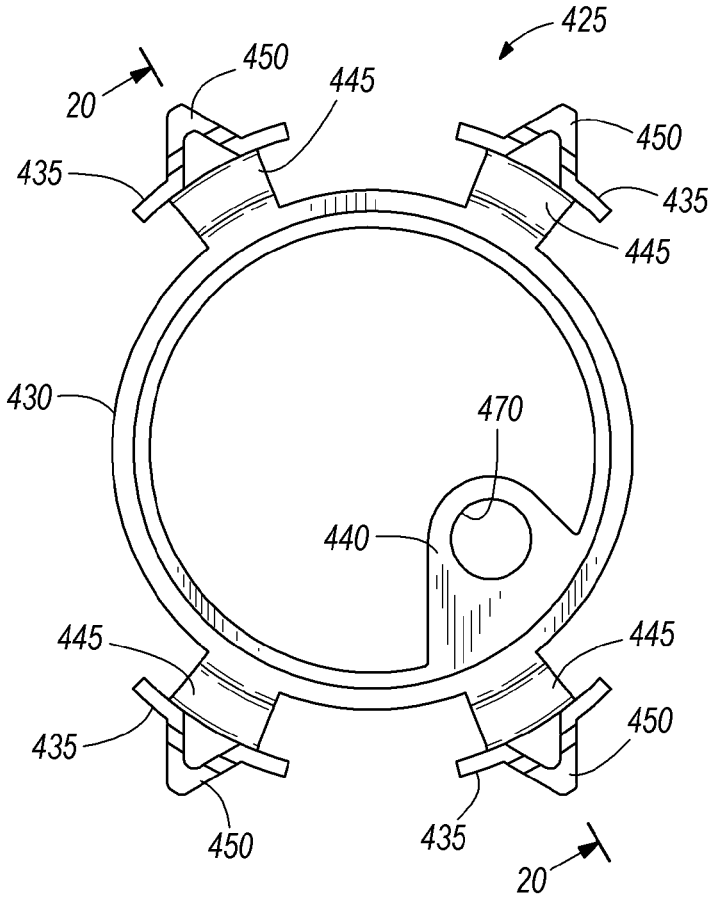
FIG. 19 is a rear view of the spacer of FIG. 16.
Figure 20:
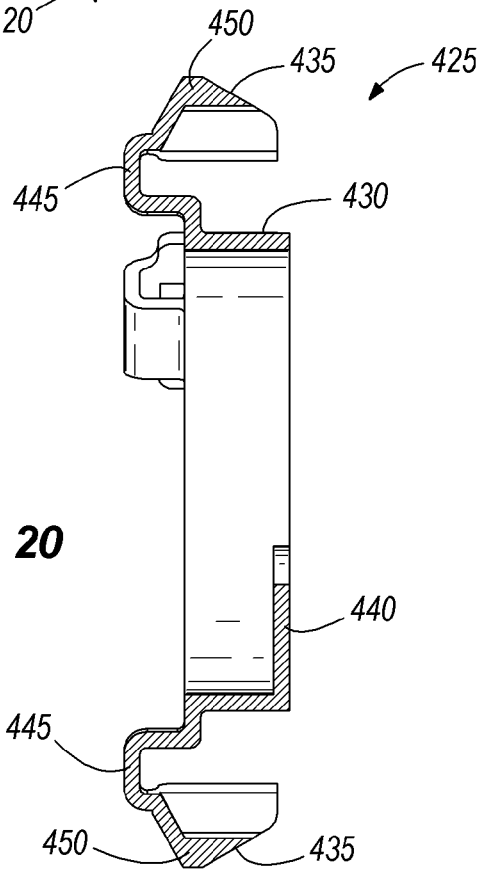
FIG. 20 is a section view of the spacer of FIG. 19 taken along line 20-20.

FIG. 18 shows that each protrusion 450 includes a lower portion that has a surface 455 with a curvature that substantially corresponds to a curvature of an inner surface of the adapter wall 375. FIGS. 16 and 17 show that the protrusions 450 also include first ends 460 that are coupled to the resilient elements 445, and second or free ends 465 that are opposite the first end such that the second ends 465 are movable inward and outward. In the illustrated construction, the protrusions 450 include a substantially pyramidal shape. In other constructions, the protrusions 450 may include a substantially spherical shape. In still other constructions, the protrusions 450 may include other shapes (e.g., rectangular, etc.).

In some constructions, the lock cylinder 300 may be without the spacer 425 such that the movable members 435 are directly attached to and radially extend outward from the adapter wall 375. In these constructions, the movable members 435 are disposed within the openings 405 so that the movable members 435 can move inward and outward. First ends of the resilient elements 445 can be directly coupled to the adapter wall 375, and the second ends of the resilient elements 445 would be free ends of the movable members 435 that are allowed to move inward and outward. In other words, the movable members 435 are attached to the adapter wall 375 adjacent one side of the movable members 435 (i.e., the side adjacent the first ends) such that the three remaining sides of the movable members 435 are free from direct attachment to the adapter wall 375.

As illustrated in FIGS. 16-20, the attachment member 440 is similar to the attachment member 175 described above with regard to FIGS. 1-8. The attachment member 440 is coupled to and extends inward from the body 430 of the spacer 425 into the space defined by the body 430 to directly attach the adapter 325 to the housing 305 using a fastener 467 (FIGS. 9-12) that is similar to the fastener 220. The attachment member 440 extends inward from the body 430 and includes a hole 470 to receive the fastener 467. In the illustrated embodiment, the attachment member 440 and the body 430 are formed as a single piece. While the illustrated attachment member 440 has a substantially triangular shape, other shapes are possible and considered herein.

In constructions of the lock cylinder 300 that include the movable members 435 located directly on the adapter 325, and that do not include the spacer 425, the adapter 325 can also include the attachment member 440 to facilitate direct attachment of the adapter 325 to the housing 305. In these constructions, the adapter wall 375, the annular flange 380, and the attachment member 440 can be formed as a single piece from any suitable material.

FIGS. 9-12 show the assembly of the lock cylinder 300. The plug assembly 310 is inserted into the housing 305 within the cavity 30, and is retained within the cavity 30 using the fastener 90 that engages an end of the plug assembly 310 and that is threadably attached to the housing 305 within the third hole 55. The fastener 90 traps the pin portion 100 of the plug assembly 20 against the wall 25 of the housing 305. The assembled housing 305 and plug assembly 310 are inserted into the spin ring 315, and are at least partially enclosed by the spin ring 315. The face plate 35 is engaged with the recessed portion 340 to hold the housing 305 in the spin ring 315.

After the housing 305 and the plug assembly 310 are inserted into the spin ring 315, the spin ring 315 is attached (e.g., crimped) to the spin ring cover 320. The spin ring cover 320 and the spin ring 315 support and protect the housing 305 and the plug assembly 310 so that damage to the housing 305 and/or the plug assembly 310 is resisted. The face plate 35 is engaged with the front wall 365 of the spin ring cover 320 after the spin ring 315 is attached to the spin ring cover 320 such that the plug 75 extends through the face plate 35 and is accessible from adjacent the outside the spin ring cover 320.

In some constructions, the lock cylinder 300 may not include the spin ring cover 320. In these constructions, the spin ring 315 functions as the spin ring 315 and the spin ring cover 320, and the housing 305 can be directly engaged with the recessed portion 340 of the spin ring 315 and at least partially enclosed by the wall 330. In other constructions, the spin ring 315 may be loosely coupled to the spin ring cover 320.

The adapter 325 is attached to the spin ring 315 prior to attachment of the latch bolt assembly 12 to the housing 305 and to the plug, and prior to insertion of the adapter 325 into the opening of the door. The adapter 325 is attached to the spin ring 315 by rotating either the adapter 325 or the spin ring 315, or both, about the first axis 385 to align the notch 420 with the first tab 345 (e.g., the smaller tab), which provides alignment of the adapter 325 with the spin ring 315 prior to attachment of these components. Next, one or both of the spin ring 315 and the adapter 325 are tilted about the second axis 390 such that the annular flange 380 is positioned behind the second tab 350, and such that the first tab 345 is inserted through the notch 420. In some constructions, the spin ring 315 or the adapter 325, or both, can be tilted about the second axis 390 prior to rotating the spin ring 315 and/or the adapter 325 to align the notch 420 with the first tab 345.

After the first tab 345 is inserted through the notch 420, either or both of the spin ring 315 and the adapter 325 are further rotated about the first axis 385 to retain the adapter 325 partially inside the spin ring 315. The first and second tabs 345, 350 are engaged with the second surface 415 of the flange 380 when the spin ring 315 and/or the adapter 325 are rotated, securing the flange 380 to the spin ring 315. The first and second tabs 345, 350 retain the adapter 325 partially within the spin ring 315 so that the adapter 325 is substantially inseparable from the spin ring 315. The use of the first and second tabs 345, 350 on the spin ring 315 and the notched annular flange 380 rigidly attach the adapter 325 to the spin ring 315, which resists access to the joint between the spin ring 315 and the adapter 325.

In the illustrated construction, the adapter 325 is rotated ninety degrees about the first axis 385 so that the notch 420 (positioned at the top of the adapter 325 in FIGS. 11-13) is aligned with the first tab 345. The adapter 325 is then tilted about the second axis 390 so that the portion of the annular flange 380 that is opposite the notch 420 is positioned behind the second tab 350, engaging the second surface 415 with the second tab 350, and so that the first tab 345 passes through the notch 420. The adapter 325 is then further rotated until the notch 420 is no longer aligned with the first tab 345 to directly attach the adapter 325 to the spin ring 315. Generally, the adapter 325 is rotated so that the cutouts 400 can be positioned substantially horizontal within the door.

The notch 420 is located in the annular flange 380 such that when the lock cylinder 300 is assembled, the first tab 345 or the second tab 350 that is received by the notch 420 may not be aligned with the notch 420. In constructions that include one of the first and second tabs 345, 350 that are larger than the other of the first and second tabs 345, 350, the smaller of first and second tabs 345, 350 is operable to align the adapter 325 with the spin ring 315, and the larger of the first and second tabs 345, 350 is operable to retain the annular flange 380, even if the notch 420 is substantially aligned with the larger of the two tabs 345, 350.

In this manner, the second tab 350 can be employed to align the cutouts 400 when the lock cylinder is inserted into the door, in addition to retaining the adapter 325 in the spin ring 315. For example, in constructions that include the notch 420 initially aligned with the first tab 345 and the cutouts 400 positioned in a substantially horizontal position relative to each other, the adapter 325 is rotated until the notch 420 is aligned with the second tab 350. Since the second tab 350 is larger than the notch 420, the adapter 325 is retained within the spin ring 315. Alignment of the notch 420 with the second tab 350 signals an end to rotation of the adapter 325 and/or the spin ring 315.

The spacer 425 can be attached to the adapter 325 before or after the adapter 325 is attached to the spin ring 315. The movable members 435 are biased inward to insert the spacer 425 into the hollow portion 395 of the adapter 325. The spacer 425 is inserted along the first axis 385 until the movable members 435 are aligned with the openings 405 in the adapter wall 375. Upon alignment with the openings 405, the movable members 435 protrude through the openings 405 and extend outward from the adapter wall 375.

The attachment member 440 is directly attached to the housing 305 using the fastener 467 prior to attachment of the latch bolt assembly 12 to the housing 305 and to the plug assembly 310, and prior to insertion of the adapter 325 into the opening in the door. The fastener 467 is inserted into the hole 470 of the attachment member 440 and is attached to the fourth hole 60 of the housing 305, similar to the embodiment described with regard to FIGS. 1-8.

The latch bolt assembly 12 is attached to the housing 15 after the lock cylinder 10 is assembled and attached to the door. Fasteners (not shown) extend through the holes 14 in the latch bolt assembly 12 and are retained in the first and second holes 45, 50 to attach the latch bolt assembly 12 to the housing 305.

In some constructions, the adapter 325 and the spacer 425 can be attached to the spin ring 315 after the housing 305 and the plug assembly 310 have been inserted into the spin ring cover 320. Similarly, the plug assembly 310 can be inserted into the housing 305 after the spin ring 315 is attached to the spin ring cover 320, and prior to engagement of the spacer 425 to the spin ring 315. In other constructions, the adapter 325 can be attached to the spin ring 315, and then the spacer 425 can be attached to the adapter 325. Other combinations of assembly of the lock cylinder 300 are also possible and are considered herein.

The assembled lock cylinder 300 including the housing 305, the plug assembly 310, the spin ring cover 320, the spin ring 315, and the adapter 325 define a modular assembly that provides easier installation of the lock cylinder 300 into the opening of the door, and that provides a relatively strong lock cylinder 300 that is resistant to tampering, including direct vertical blows to the spin ring cover 320 and/or the adapter 325. The movable members 435 protrude outward from the adapter wall 375 to engage the wall of the opening in the door to provide hands-free attachment of the modular assembly to the door. The wall of the door slightly compresses or moves the movable members 435 inward to rigidly couple the modular assembly to the wall. In this manner, the modular assembly can be positioned in the opening of the door and left in the opening without an installer having to hold the modular assembly while attaching the latch bolt assembly 12 to the housing 305. The adapter 325 is partially recessed in the spin ring 315 to protect the latch bolt after the latch bolt assembly 12 is attached to the housing 305. The adapter wall 375 resists access to and tampering of the latch bolt assembly 12, and supports the housing 305, the plug assembly 310, the spin ring cover 320, and the spin ring 315.

Generally, the closer that the openings 405, and therefore, the movable members 435, are to a vertical location (e.g., close to the second axis 390 in FIG. 14), the better the movable members 435 are able hold the adapter 325, and therefore the modular assembly, to the wall defining the opening in the door. The vertically oriented movable members 435 avoid interference with the cutouts 400 so that the adapter 325 can be adequately fixed to the wall. However, the openings 405 and the movable members 435 can be located anywhere on the adapter wall 375 to fix the adapter 325 to the wall. The flexibility of the movable members 435 also allow the modular assembly to adapt to different-sized lock cylinder 300 openings in doors, providing a universal lock cylinder 300.

In addition, the modular assembly has a relatively low cost and provides easy installation of the lock cylinder 300 and the latch bolt assembly 12 into the door. An installer or user can insert the modular assembly into the opening of the door, and then attach the latch bolt assembly 12 to the housing 305 using the latch bolt assembly 12 fasteners without concern for separation of the components of the modular assembly during installation, or that the modular assembly will fall out of the opening in the door. After the latch bolt assembly 12 is attached to the housing 305, the key can be used to rotate the plug to lock and unlock the door. The adapter 325 is rigidly attached to the housing 305 using the fastener, which resists one or more of the components of the lock cylinder 300 from separating from the remaining components prior to insertion of the lock cylinder 300 into the door and prior to engagement of the lock cylinder 300 with the latch bolt assembly 12.

Various features and advantages of the invention are set forth in the following claims.

What is claimed is:

1. A lock cylinder for a door including an opening, the lock cylinder operable to interact with a latch bolt assembly, the lock cylinder comprising:

a housing including a cavity;

a plug assembly including a casing and a plug housed in the casing and rotatable between a locked position and an unlocked position, the plug operable to interact with the latch bolt assembly, and the casing disposed within the cavity;

a spin ring member at least partially enclosing the housing;

an adapter including a spin ring interface engaged with the spin ring member, and a shield portion extending axially away from the spin ring interface and extendable into the opening of the door;

a flexible movable member extending radially outward from the shield portion and configured to engage the door to couple the adapter to the door; and an attachment member extending radially inward from the shield portion to directly attach the adapter to the housing.

2. The lock cylinder of claim 1, wherein the spin ring interface includes a recessed wall defining an aperture, and wherein the attachment member extends from the recessed wall into the aperture.

3. The lock cylinder of claim 2, wherein a portion of the spin ring member is recessed within the spin ring interface.

4. The lock cylinder of claim 1, wherein the spin ring interface and the attachment member are formed as a single piece.

5. The lock cylinder of claim 1, wherein the housing includes a first hole, and wherein the attachment member includes a second hole, further comprising a fastener extending through the second hole and attached to the housing within the first hole.

6. A lock cylinder for a door including a wall defining an opening, the lock cylinder operable to interact with a latch bolt assembly, the lock cylinder comprising:

a housing including a cavity;

a plug assembly including a casing and a plug housed in the casing and rotatable between a locked position and an unlocked position, the plug operable to interact with the latch bolt assembly, and the casing disposed within the cavity;

a spin ring member at least partially enclosing the housing, the spin ring member including a tab member;

an adapter including a wall portion and an annular flange disposed about at least a portion of the wall portion, the flange having a notch configured to receive the tab member, a first surface adjacent an end of the adapter, and a second surface opposite the first surface such that the tab member is engaged with the second surface, the flange retained by the tab member to directly attach the adapter to the spin ring member; and at least one movable member extending outward from the wall portion and configured to engage the wall of the door to couple the adapter to the door, the movable member being movable inward toward the wall portion against a force biasing the movable member outward.

7. The lock cylinder of claim 6, wherein the tab member extends through the notch to attach the adapter to the spin ring member.

8. The lock cylinder of claim 6, wherein the tab member is disposed along an inner wall portion of the spin ring member.

9. The lock cylinder of claim 7, wherein the tab member includes a first tab and a second tab, and wherein the first tab is operable to align the adapter with the spin ring member, and wherein the second tab is operable to retain the adapter.

10. The lock cylinder of claim 9, wherein the second tab is larger than the first tab, and wherein the size of the notch is substantially equal to the size of the first tab.

11. The lock cylinder of claim 9, wherein the first tab and the second tab are configured to resist separation of the adapter from the spin ring member.

12. A lock cylinder for a door including a wall defining an opening, the lock cylinder operable to interact with a latch bolt assembly, the lock cylinder comprising:

a housing including a cavity;

a plug assembly including a casing and a plug housed in the casing and rotatable between a locked position and an unlocked position, the plug operable to interact with the latch bolt assembly, and the casing disposed within the cavity;

a spin ring member at least partially enclosing the housing;

an adapter coupled to the spin ring member and including a wall portion; and at least one movable member extending radially outward from the wall portion and configured to engage the wall of the door to couple the adapter to the door, the movable member being movable inward toward the wall portion against a force biasing the movable member outward.

13. The lock cylinder of claim 12, wherein the movable member includes a resilient element and a protrusion extending from the resilient element.

14. The lock cylinder of claim 13, wherein the adapter includes a hole extending through the wall portion, and wherein the protrusion protrudes through the hole.

15. The lock cylinder of claim 12, further comprising a spacer including a body, wherein the movable member extends radially outward from the body.

16. The lock cylinder of claim 15, wherein the movable member and the spacer are formed as a single piece.

17. The lock cylinder of claim 15, wherein the spacer includes an attachment member coupled to and extending inward from the body to attach the adapter to the housing, and wherein the attachment member and the spacer are formed as a single piece.

18. The lock cylinder of claim 17, wherein the housing includes a first hole, and wherein the attachment member includes a second hole, further comprising a fastener extending through the second hole and attached to the housing within the first hole.

19. The lock cylinder of claim 12, further comprising a first movable member and a second movable member, wherein the second movable member is angularly spaced apart from the first movable member.

20. The lock cylinder of claim 19, wherein the first movable member and the second movable member are angularly spaced apart by about 60 degrees.

21. The lock cylinder of claim 12, wherein the movable member is configured to engage the wall of the door to provide hands-free attachment of the housing, the plug assembly, the spin ring member, and the adapter to the latch bolt assembly.

22. The lock cylinder of claim 12, wherein the movable member includes a flexible material configured to accommodate different-sized openings.

23. The lock cylinder of claim 22, wherein the flexible material includes plastic.

24. The lock cylinder of claim 12, wherein the movable member includes a substantially pyramidal shape.

25. The lock cylinder of claim 12, wherein the spin ring member further includes one of a tab member and a notch, wherein the adapter further includes the other of the tab member and the notch, and wherein the notch is configured to receive the tab member to directly attach the adapter to the spin ring member.

26. The lock cylinder of claim 25, wherein the spin ring member includes the tab member, and wherein the adapter includes an annular flange disposed about at least a portion of a wall portion of the adapter and having the notch, and wherein the annular flange is retained by the tab member.

27. The lock cylinder of claim 26, wherein the flange further includes a first surface adjacent an end of the adapter and a second surface opposite the first surface, and wherein the tab member is engaged with the second surface.

28. The lock cylinder of claim 25, wherein the tab member includes a first tab and a second tab, and wherein the first tab is configured to align the adapter with the spin ring member and the second tab is configured to attach the adapter to the spin ring member.

29. The lock cylinder of claim 28, wherein the second tab is larger than the first tab, and wherein the size of the notch is substantially equal to the size of the first tab.

30. A method of assembling a lock cylinder for a door including a wall defining an opening, the lock cylinder operable to interact with a latch bolt assembly, the method comprising:

providing a housing including a cavity, the housing configured to interact with the latch bolt assembly;

providing a plug assembly insertable into the cavity and configured to be operably coupled to the latch bolt assembly, the plug assembly including a casing and a plug housed in the casing and rotatable between a locked position and an unlocked position, and the casing disposed within the cavity;

providing a spin ring member including a hollow portion and a tab member;

providing an adapter including an aperture defining an axis, the adapter configured to be inserted into the opening in the door, the adapter including a wall portion and an annular flange disposed about at least a portion of the wall portion, the flange having a notch configured to receive the tab member, a first surface adjacent an end of the adapter, and a second surface opposite the first surface;

providing at least one movable member extending outward from the wall portion and configured to engage the wall of the door to couple the adapter to the door, the movable member being movable inward toward the wall portion against a force biasing the movable member outward;

inserting the plug assembly into the cavity of the housing;

inserting the housing into the hollow portion of the spin ring member such that the spin ring member at least partially encloses the housing; and attaching the adapter to the spin ring member by engaging the tab member with the second surface such that the flange is retained by the tab member to directly attach the adapter to the spin ring member prior to attachment of the latch bolt assembly to the housing and to the plug and prior to insertion of the adapter into the opening in the door.

31. The method of claim 30, further comprising rotating one of the spin ring member and the adapter about the first axis.

32. The method of claim 31, further comprising aligning the notch with the tab member; and inserting the tab member through the notch.

33. The method of claim 32, wherein aligning the notch with the tab member includes tilting one of the spin ring member and the adapter about a second axis substantially perpendicular to the first axis.

34. The method of claim 30, further comprising aligning the notch with a first tab of the tab member;

tilting one of the spin ring member and the adapter about a second axis substantially perpendicular to the first axis;

inserting the first tab through the notch;

rotating one of the spin ring member and the adapter about the first axis; and retaining the adapter in the spin ring member using a second tab of the tab member.

35. A method of installing a lock cylinder into a door including a wall defining an opening, the lock cylinder operable to interact with a latch bolt assembly, the method comprising:

providing a housing including a cavity;

providing a plug assembly insertable into the cavity and including a casing and a plug housed in the casing and rotatable between a locked position and an unlocked position, the plug operable to interact with the latch bolt assembly, and the casing disposed within the cavity;

providing a spin ring member including a hollow portion such that the spin ring member at least partially encloses the housing;

providing an adapter configured to be inserted into the opening in the door, the adapter including a wall portion and at least one movable member extending radially outward from the wall portion, the member being movable inward toward the wall portion against a force biasing the member outward;

inserting the plug assembly into the cavity of the housing;

inserting the housing into the spin ring member;

attaching the adapter to the spin ring member; and inserting the adapter into the opening in the door so that the movable member engages the wall of the door and at least temporarily holds the adapter in the opening of the door.

36. The method of claim 35, further comprising providing hands-free installation of the latch bolt assembly by attaching a modular assembly including the housing, the plug assembly, the spin ring member, and the adapter into the door using the movable member.

37. The method of claim 35, wherein providing the movable member includes providing a spacer including the movable member;

engaging the spacer with the adapter;

inserting the movable member through a hole in the adapter; and engaging the movable member with the wall of the door.

38. A lock cylinder for a door including a wall defining an opening, the lock cylinder operable to interact with a latch bolt assembly, the lock cylinder comprising:

a housing including a cavity;

a plug assembly including a casing and a plug housed in the casing and rotatable between a locked position and an unlocked position, the plug operable to interact with the latch bolt assembly, and the casing disposed within the cavity;

a spin ring member at least partially enclosing the housing;

an adapter coupled to the spin ring member and including a wall portion;

at least one movable member extending outward from the wall portion and configured to engage the wall of the door to couple the adapter to the door, the movable member being movable inward toward the wall portion against a force biasing the movable member outward; and a spacer including a body, the movable member extending radially outward from the body.

39. The lock cylinder of claim 38, wherein the movable member includes a resilient element and a protrusion extending from the resilient element.

40. The lock cylinder of claim 39, wherein the adapter includes a hole extending through the wall portion, and wherein the protrusion protrudes through the hole.

41. The lock cylinder of claim 38, further comprising a first movable member and a second movable member, wherein the second movable member is angularly spaced apart from the first movable member.

42. The lock cylinder of claim 41, wherein the first movable member and the second movable member are angularly spaced apart by about 60 degrees.

43. The lock cylinder of claim 38, wherein the movable member is configured to engage the wall of the door to provide hands-free attachment of the housing, the plug assembly, the spin ring member, and the adapter to the latch bolt assembly.

44. The lock cylinder of claim 38, wherein the movable member includes a flexible material configured to accommodate different-sized openings.

45. A lock cylinder for a door including a wall defining an opening, the lock cylinder operable to interact with a latch bolt assembly, the lock cylinder comprising:

a housing including a cavity;

a plug assembly including a casing and a plug housed in the casing and rotatable between a locked position and an unlocked position, the plug operable to interact with the latch bolt assembly, and the casing disposed within the cavity;

a spin ring member at least partially enclosing the housing and including one of a tab member and a notch;

an adapter coupled to the spin ring member and including a wall portion, the adapter further including the other of the tab member and the notch, the notch configured to receive the tab member to directly attach the adapter to the spin ring member, the tab member including a first tab configured to align the adapter with the spin ring member, and a second tab larger than the first tab and configured to attach the adapter to the spin ring member, the size of the notch substantially equal to the size of the first tab; and at least one movable member extending outward from the wall portion and configured to engage the wall of the door to couple the adapter to the door, the movable member being movable inward toward the wall portion against a force biasing the movable member outward.

46. The lock cylinder of claim 45, wherein the movable member includes a resilient element and a protrusion extending from the resilient element.

47. The lock cylinder of claim 46, wherein the adapter includes a hole extending through the wall portion, and wherein the protrusion protrudes through the hole.

48. The lock cylinder of claim 45, further comprising a spacer including a body, wherein the movable member extends radially outward from the body.

49. The lock cylinder of claim 48, wherein the movable member and the spacer are formed as a single piece.

50. The lock cylinder of claim 48, wherein the spacer includes an attachment member coupled to and extending inward from the body to attach the adapter to the housing, and wherein the attachment member and the spacer are formed as a single piece.

51. The lock cylinder of claim 50, wherein the housing includes a first hole, and wherein the attachment member includes a second hole, further comprising a fastener extending through the second hole and attached to the housing within the first hole.

52. The lock cylinder of claim 45, further comprising a first movable member and a second movable member, wherein the second movable member is angularly spaced apart from the first movable member.

53. The lock cylinder of claim 45, wherein the spin ring member includes the tab member, and wherein the adapter includes an annular flange disposed about at least a portion of a wall portion of the adapter and having the notch, and wherein the annular flange is retained by the tab member.

54. The lock cylinder of claim 53, wherein the tab member is disposed along an inner wall portion of the spin ring member.

55. The lock cylinder of claim 53, wherein the flange further includes a first surface adjacent an end of the adapter and a second surface opposite the first surface, and wherein the tab member is engaged with the second surface.

56. The lock cylinder of claim 45, wherein the movable member is configured to engage the wall of the door to provide hands-free attachment of the housing, the plug assembly, the spin ring member, and the adapter to the latch bolt assembly.

* * * * *